US007619588B2

(12) United States Patent
Yang et al.

(10) Patent No.: US 7,619,588 B2
(45) Date of Patent: Nov. 17, 2009

(54) PLASMA DISPLAY DEVICE AND METHOD FOR DRIVING THE SAME

(75) Inventors: Heechan Yang, Busan (KR); Yunkwon Jung, Gumi-si (KR); Jinyoung Kim, Daegu (KR)

(73) Assignee: LG Electronics Inc., Seoul (KR)

( * ) Notice: Subject to any disclaimer, the term of this patent is extended or adjusted under 35 U.S.C. 154(b) by 643 days.

(21) Appl. No.: 11/281,439

(22) Filed: Nov. 18, 2005

(65) Prior Publication Data

US 2006/0109212 A1 May 25, 2006

(30) Foreign Application Priority Data

Nov. 19, 2004 (KR) ..... 10-2004-0095414
Dec. 8, 2004 (KR) ..... 10-2004-0103261
Dec. 9, 2004 (KR) ..... 10-2004-0103877

(51) Int. Cl.
*G09G 3/28* (2006.01)

(52) U.S. Cl. ..... 345/67; 345/63; 345/65; 345/68; 345/69

(58) Field of Classification Search ..... 345/60–71, 345/173, 208, 211, 212; 315/169.1–169.4; 313/582
See application file for complete search history.

(56) References Cited

U.S. PATENT DOCUMENTS 3,765,011 A * 10/1973 Sawyer et al. ..... 345/60
4,030,091 A * 6/1977 Ngo ..... 345/68
5,990,630 A * 11/1999 Nakamura ..... 315/169.4
6,175,192 B1 * 1/2001 Moon ..... 315/169.3
6,414,658 B1 * 7/2002 Tokunaga ..... 345/63
6,483,487 B2 * 11/2002 Iseki ..... 345/60
6,624,798 B1 * 9/2003 Aoki et al. ..... 345/60
6,803,888 B1 10/2004 Nakamura
6,924,795 B2 * 8/2005 Kawasaki et al. ..... 345/204
RE39,236 E * 8/2006 Imamura ..... 345/211
7,176,851 B2 * 2/2007 Shiokawa et al. ..... 345/60
7,327,358 B2 * 2/2008 Tajiri et al. ..... 345/208
7,338,337 B2 * 3/2008 Yamauchi et al. ..... 445/6
7,436,375 B2 * 10/2008 Hirakawa et al. ..... 345/60
2001/0016605 A1 8/2001 Dehne et al. ..... 514/596
2001/0017605 A1 8/2001 Hashimoto et al. ..... 345/60
2001/0024179 A1 * 9/2001 Nakamura ..... 345/60
2003/0222835 A1 * 12/2003 Yoon et al. ..... 345/60
2004/0108975 A1 * 6/2004 Araki ..... 345/63
2004/0251830 A1 * 12/2004 Nagao et al. ..... 313/582
2005/0068266 A1 * 3/2005 Sano et al. ..... 345/60

(Continued)

FOREIGN PATENT DOCUMENTS

CN 1438619 A 8/2003

(Continued)

OTHER PUBLICATIONS

European Search Report dated Jan. 4, 2007.

(Continued)

*Primary Examiner*—Prabodh M Dharia
(74) *Attorney, Agent, or Firm*—KED & Associates, LLP

(57) ABSTRACT

In a plasma display device, the application of at least one address signal to a cell receiving a scan signal is offset from the application of the scan signal. Such offset improves picture quality and/or reduces noise.

26 Claims, 32 Drawing Sheets

U.S. PATENT DOCUMENTS

| | | | | |
|---|---|---|---|---|
| 2005/0077836 | A1* | 4/2005 | Jin et al. | 315/169.4 |
| 2005/0088375 | A1 | 4/2005 | Son | 345/60 |
| 2005/0225511 | A1* | 10/2005 | Kawasaki et al. | 345/60 |
| 2006/0022967 | A1* | 2/2006 | Hirakawa et al. | 345/204 |
| 2006/0044221 | A1* | 3/2006 | Kim et al. | 345/60 |
| 2006/0103593 | A1* | 5/2006 | Jung et al. | 345/60 |
| 2006/0103594 | A1* | 5/2006 | Kim et al. | 345/60 |
| 2006/0114178 | A1* | 6/2006 | Yang et al. | 345/60 |
| 2006/0125725 | A1* | 6/2006 | Yang et al. | 345/67 |

FOREIGN PATENT DOCUMENTS

| | | | |
|---|---|---|---|
| EP | 0 853 306 | B1 | 7/1998 |
| EP | 1 336 950 | A2 | 8/2003 |
| EP | 1 387 344 | A2 | 2/2004 |
| JP | 08-305319 | | 11/1996 |
| JP | 2001-084914 | | 3/2001 |
| JP | 2001-272948 | | 10/2001 |
| KR | 10-2003-0027173 | A | 4/2003 |
| KR | 10-2004-0085986 | A | 10/2004 |
| TW | 498299 | | 8/2002 |

OTHER PUBLICATIONS

Chinese Office Action dated Sep. 14, 2007 and English-language translation.
European Search Report dated Jul. 14, 2006.
Taiwanese Office Action dated Jun. 23, 2009.

* cited by examiner

PLASMA DISPLAY DEVICE AND METHOD FOR DRIVING THE SAME

CROSS-REFERENCE TO RELATED APPLICATIONS

This Nonprovisional application claims priority under 35 U.S.C. § 119(a) on Patent Application Nos. 10-2004-0095414 and 10-2004-0103261 and 10-2004-0103877 filed in Korea on Nov. 19, 2004 and Dec. 8, 2004 and Dec. 9, 2004 the entire contents of which are hereby incorporated by reference.

BACKGROUND OF THE INVENTION

1. Field of the Invention

The present invention relates to a display device and more particularly, a plasma display device and a driving method thereof.

2. Background of the Related Art

In general, a plasma display panel is formed of unit cells, and each unit cell includes a front substrate, a rear substrate and a barrier rib or a partition formed between the substrates. Each cell is filled with an inert gas mixture containing neon (Ne), helium (He) or major discharge gases such as a mixed gas of Ne+He, and a small amount of xenon. When discharge occurs by a radio frequency voltage, the inert gas generates vacuum ultraviolet rays and irradiates fluorescent substances formed between barrier ribs to display an image. The plasma display panel is thin and light.

FIG. 1 illustrates the image gradation processing method used in a plasma display panel. According to the gray level of an image, a frame is divided into a plurality of subfields of different number of luminescence. Each subfield is composed of a reset period (RPD) for initializing (or resetting) all cells, an address period (APD) for selecting a cell to be discharged, and a sustain period (SPD) for implementing gray level by a number of discharges. For instance, if an image is displayed in 256 gray levels, a frame period (16.67 ms) corresponding to 1/60 sec is divided into 8 subfields SF1-SF8, and each of the subfields SF1-SF8 is subdivided into a reset period, an address period, and a sustain period.

The reset period and the address period are uniformly set for every subfield. The address discharge for selecting a cell to be discharged arises by potential difference between the address electrode and the scan electrode. The sustain period in each subfield increases at the rate of $2^n$ (n=0, 1, 2, 3, 4, 5, 6, 7). Since the sustain period changes in each subfield, the sustain period of each subfield, that is, the number of sustain discharges, can be adjusted to express an image in gray level.

FIG. 2 is an illustration of driving waveforms for a plasma display panel. The operation of the plasma display panel is performed using four periods in each subfield as follows: a reset period for initializing all the cells, an address period for selecting a cell to be discharged, a sustain period for sustaining discharge of the selected cell, and an erase period for erasing wall charged formed in the discharged cell.

A rising ramp waveform (Ramp-up) is simultaneously applied to all the scan electrodes in the set-up interval of the reset period. The rising ramp waveform (Ramp-up) causes a weak dark discharge within discharge cells. By the set-up discharge, wall charges with straight polarity (e.g., positive voltage) are accumulated on the address electrode and the sustain electrode, and wall charges with reverse polarity (e.g., negative voltage) are accumulated on the scan electrode.

In the set-down interval of the reset period, a falling ramp waveform (Ramp-down) falling from a positive voltage lower than a peak voltage of the rising ramp waveform (Ramp-up) to a specific voltage level, preferably lower than a ground (GND) voltage level, causes a weak erasure discharge within the cells, to thereby erase excessively formed wall charges on the scan electrode. The set-down discharge uniformly leaves wall charges required for the stable address discharge within the cells.

In the address period, a negative scan signal is sequentially applied to the scan electrodes, and a positive data signal is applied to the address electrode synchronously with the scan signal. A potential difference between the scan signal and the data signal adds to a wall voltage generated during the reset period, to generate an address discharge within the discharge cells to which the data signal is applied. The wall charges are formed within the cells selected by the address discharge, in order to cause discharge when a sustain voltage Vs is provided during the sustain period. In the meantime, a positive voltage Vz is provided to the sustain electrode (Z) during the set-down interval and the address period, in order to reduce the potential difference with the scan electrode, thereby preventing erroneous discharge with the scan electrode.

In the sustain period, a sustain signal Sus is alternately applied to the scan electrodes and the sustain electrodes. The wall voltage within the cell selected by the address discharge is added to the sustain signal, and hence, a sustain discharge, i.e., display discharge, is generated between the scan electrode and the sustain electrode every time a sustain signal is applied to either the scan electrode Y or the sustain electrode Z. After the sustain discharge, a voltage of an erasing ramp waveform (Ramp-ers) having a small signal width and a low voltage level is provided to the sustain electrode to thereby erase remaining wall charges within the cells.

In case of a plasma display panel driven by the above-described driving waveform, in the address period, the scan signal and the data signal are concurrently applied to the corresponding scan electrodes and the address electrodes $X_1$-$X_n$. FIG. 3 is an illustration of a timing chart of signals applied to corresponding selected scan electrode Ym and address electrodes $X_1$-$X_n$ in the address period.

As shown in FIG. 3, in the address period, the corresponding data signals are applied to the address electrodes $X_1$-$X_n$ concurrently (i.e., at ts) with the scan signal provided to a selected scan electrode for selecting the corresponding cells in a row of the plasma display device. When the corresponding data signals and the scan signal are applied simultaneously to the address electrodes $X_1$-$X_n$ and the scan electrode, respectively, noises are generated in a waveform applied to the scan electrode and a waveform applied to the sustain electrode. FIG. 4 is an explanatory diagram of the problems caused by signals provided to the address electrode and the scan electrode during the address period.

If data signals and a scan signal are applied to the corresponding address electrodes $X_1$-$X_n$ and the scan electrode, respectively, noises are generated in the waveforms. In general, these noises are generated because of the coupling of panels through capacitance. When a data signal rises rapidly, noises rise in the waveforms being applied to the scan electrode and the sustain electrode. Similarly, when a data signal falls rapidly, noises also fall in the waveforms being applied to the scan electrode and the sustain electrode. These noises make the address discharge occurred in the address period unstable, and reduces the driving efficiency of the plasma display panel.

In general, the above driving waveform often generates erroneous discharge when the temperature of the panel is high or low. Erroneous discharge caused by a high ambient temperature of the panel is called a high-temperature erroneous discharge, and erroneous discharge caused by a low ambient temperature of the panel is called a low-temperature erroneous discharge.

FIG. 5 is an explanatory diagram of the high-temperature erroneous discharge in a plasma display panel driven caused by the driving waveform. If the temperature around the panel is relatively high, the recoupling rate or recombination rate between space charges 701 and wall charges 700 within a discharge cell increases. The space charges 701 are charges existing in the space within the discharge cell, and unlike the wall charges 700, space charges 701 do not participate in the discharge. In result, the absolute amount of wall charges participating in a discharge is reduced, and erroneous discharge occurs.

For example, if the recoupling rate between the space charges 701 and the wall charges 700 is increased in the address period, the amount of wall charges 700 participating in the address discharge is reduced, resulting in an unstable address discharge. In this case, the address discharge becomes even more unstable because there is enough time for recoupling between the space charges 701 and the wall charges 700 in the latter half of addressing. Therefore, a discharge cell that was turned on in the address period may be turned off in the sustain period (i.e., the high-temperature erroneous discharge).

Moreover, if the temperature around the panel is relatively high and a sustain discharge occurs in the sustain period, the space charges 701 move faster during the discharge, so more space charges 701 are recoupled with the wall charges 700. Thus, after any sustain discharge, the amount of wall charges 700 participating in the sustain discharge is reduced due to the recoupling or recombination between the space charges 701 and the wall charges 700. In consequence, a next sustain discharge may not be generated at all (i.e., the high-temperature erroneous discharge).

FIG. 6 is an explanatory diagram of the low-temperature erroneous discharge caused by the driving waveform. If the temperature around the panel is relatively low, heat energy supplied into a discharge cell is reduced. Thus, the absolute amount of seed electrons that collide with neutrons for producing other electrons is decreased, resulting in erroneous discharge. According to the plasma discharge mechanism, a predetermined energy, e.g., heat energy, inside a discharge cell is applied to a certain seed electron. Then, the seed electron is accelerated by the energy, and collides with a neutron. The same neutron emits an electron as a result of the collision, and the emitted electron collides with another neutron for emitting still another electron. In this manner, plasma discharge is generated.

However, if the temperature around the plasma display panel generating the plasma discharge becomes relatively low, the amount of heat energy to be applied to a seed electron is reduced. Accordingly, the plasma discharge mechanism cannot be operated smoothly. That is, the plasma discharge mechanism slows down and the erroneous discharge occurs. For instance, the address discharge does not occur in the address period due to the reduction of heat energy. Hence, a discharge cell that needs to be turned on in the sustain period is often turned off (i.e., the low-temperature erroneous discharge).

The above descriptions are incorporated by reference herein where appropriate for appropriate teachings of additional or alternative details, features and/or technical background.

SUMMARY OF THE INVENTION

An object of the present invention is to solve at least the problems and disadvantages of the related art.

An object of the present invention is to reduce noise.

Another object of the present invention is to prevent high-temperature erroneous discharge.

Another object of the present invention is to prevent low-temperature erroneous discharge.

The present invention can be achieved in a whole or in parts by a driving method of a plasma display device including the steps of: grounding the sustain electrode during a set-down interval of the reset period; applying a scan signal to the scan electrode in the address period; and in response to the scan signal, applying data signals to at least one of a plurality of address electrode groups, each electrode group including at least one address electrode, at different timings from an application timing of the scan signal to the scan electrode.

The present invention can be achieved in a whole or in parts by a driving method of a plasma display device including the steps of: grounding the sustain electrode during a set-down interval of the reset period; applying a scan signal to the scan electrode in the address period; and dividing address electrodes into a plurality of electrode groups, and applying data signals to at least one electrode group at different timings from application timings of the data signals to the other electrode groups.

According to an embodiment of the present invention, it becomes possible to reduce noises of waveforms being applied to the scan electrode and the sustain electrode by adjusting application timings of the scan signal and the data signal(s) that are applied to the scan electrode and the address electrode(s), respectively, during the address period. In result, the address discharge can be generated stably, and the operational efficiency of the panel can be enhanced.

Also, the present invention can be advantageously used for preventing high-temperature erroneous discharge/low-temperature erroneous discharge by providing, before the reset period, a pre-reset period for accumulating wall charges within a discharge cell.

The present invention can be achieved in a whole or in parts by a plasma display device provided with a scan electrode, a sustain electrode, and address electrodes intersecting with the scan electrode and the sustain electrode, the device including: a scan driver for applying a scan signal to the scan electrode in an address period; a sustain driver for grounding the sustain electrode during a set-down interval of the reset period; and a data driver, in response to the scan signal, for differentiating timings of data signals being applied to one of a plurality of address electrode groups, each electrode group including at least one address electrode, from an application timing of a scan signal to the scan electrode.

Preferably, a pre-reset period for accumulating wall charges within a discharge cell is provided before the reset period.

In an exemplary embodiment, data signals are applied to at least one of the plurality of address electrode groups earlier than the application timing of the scan signal to the scan electrode.

In an exemplary embodiment, data signals are applied to at least one of the plurality of address electrode groups later than the application timing of the scan signal to the scan electrode.

In an exemplary embodiment, each of the plurality of the address electrode groups includes the same number of address electrodes.

In an exemplary embodiment, at least one of the plurality of the address electrode groups includes a different number of address electrodes from the other address electrode groups.

In an exemplary embodiment, wherein every address electrode in the same address electrode group receives a data signal at the same point.

Preferably, the application timing difference between the scan signal and the data signals is in a range from 10 ns to 1000 ns.

Preferably, the application timing difference between the scan signal and the data signals is in a range from 1/100 to 1 time(s) of the scan signal width.

In an exemplary embodiment, among the data signal application timings for the plurality of address electrode groups, the difference between two (temporarily) subsequent data signal application timings is a constant value.

In an exemplary embodiment, among the data signal application timings for the plurality of address electrode groups, the difference between two (temporarily) subsequent data signal application timings varies from one another.

Preferably, among the data signal application timings for the plurality of address electrode groups, the difference between two (temporarily) subsequent data signal application timings is in a range from 10 ns to 1000 ns.

In an exemplary embodiment, before the reset period, a ramp waveform characterized of a gradually changing voltage is applied to the scan electrode or the sustain electrode.

In an exemplary embodiment, before the reset period, a negative waveform is applied to the scan electrode, and a positive waveform is applied to the sustain period.

In an exemplary embodiment, the negative waveform applied to the scan electrode is a falling ramp waveform (Ramp-down), and the positive waveform applied to the sustain electrode is a square wave.

In an exemplary embodiment, the voltage of the falling ramp waveform (Ramp-down) applied to the scan electrode falls from a ground level (GND) to a predetermined voltage level.

In an exemplary embodiment, a lower limit of the voltage of the falling ramp waveform (Ramp-down) applied to the scan electrode is equal to a lower limit of the scan signal voltage applied to the scan electrode during the address period.

In an exemplary embodiment, the voltage of the positive waveform applied to the sustain electrode is the sustain signal voltage (Vs) applied to the sustain electrode after the address period.

The present invention can be achieved in a whole or in parts by a plasma display device provided with a scan electrode, a sustain electrode, and address electrodes intersecting with the scan electrode and the sustain electrode, the device comprising: a scan driver for applying a scan signal to the scan electrode in an address period; a sustain driver for grounding the sustain electrode during a set-down interval of the reset period; and a data driver, in response to the scan signal, for applying data signals to at least one of a plurality of address electrode groups, each electrode group including at least one address electrode, at different timings from data signal application timings for other address electrode groups.

Each of the plurality of the address electrode groups preferably includes the same number of address electrodes. Alternatively, at least one of the plurality of the address electrode groups includes a different number of address electrodes from the other address electrode groups. Every address electrode in the same address electrode group preferably receives a data signal at the same point.

The application timing difference between the scan signal and the data signals is preferably in a range from 10 ns to 1000 ns. Alternatively, the application timing difference between the scan signal and the data signals is preferably in a range from 1/100 to 1 time(s) of the scan signal width.

Among the data signal application timings for the plurality of address electrode groups, the difference between two (temporarily) subsequent data signal application timings is preferably a constant value. Alternatively, among the data signal application timings for the plurality of address electrode groups, the difference between two (temporarily) subsequent data signal application timings varies from one another. Among the data signal application timings for the plurality of address electrode groups, the difference between two (temporarily) subsequent data signal application timings is preferably in a range from 10 ns to 1000 ns.

Before the reset period, a negative waveform is preferably applied to the scan electrode, and a positive waveform is preferably applied to the sustain electrode. The negative waveform applied to the scan electrode is a falling ramp waveform (Ramp-down), and the positive waveform applied to the sustain electrode is a square wave. The voltage of the falling ramp waveform (Ramp-down) applied to the scan electrode preferably falls from a ground level (GND) to a predetermined voltage level. A lower limit of the voltage of the falling ramp waveform (Ramp-down) applied to the scan electrode is preferably equal to a lower limit of the scan signal voltage applied to the scan electrode during the address period. The voltage of the positive waveform applied to the sustain electrode is preferably the sustain signal voltage (Vs) applied to the sustain electrode after the address period.

The present invention can be achieved in a whole or in parts by a driving method of a plasma display device displaying an image by applying a predetermined signal to a scan electrode, a sustain electrode and address electrodes ($X_1$-$X_n$) (n is a positive integer) in a reset period, an address period, and a sustain period, respectively, the method comprising the steps of: during a set-down interval of the reset period, grounding the sustain electrode; in the address period, applying a scan signal to the scan electrode; and in response to the scan signal, applying data signals to at least one of a plurality of address electrode groups, each electrode group including at least one address electrode, at different timings from an application timing of the scan signal to the scan electrode. A pre-reset period for accumulating the amount of wall changes within a discharge cell is preferably set before the reset period.

The present invention can be achieved in a whole or in parts by a driving method of a plasma display device displaying an image by applying a predetermined signal to a scan electrode, a sustain electrode and first and second address electrodes ($X_1$-$X_n$) (n is a positive integer) in a reset period, an address period, and a sustain period, respectively, the method comprising the steps of: during a set-down interval of the reset period, grounding the sustain electrode; in the address period, applying a scan signal to the scan electrode; and in response to the scan signal, applying data signals at different timings from application timings of the data signals to the first and second address electrodes. A pre-reset period for accumulating the amount of wall changes within a discharge cell is preferably set before the reset period.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

BEST MODE OR DETAILED DESCRIPTION

Figure 1:
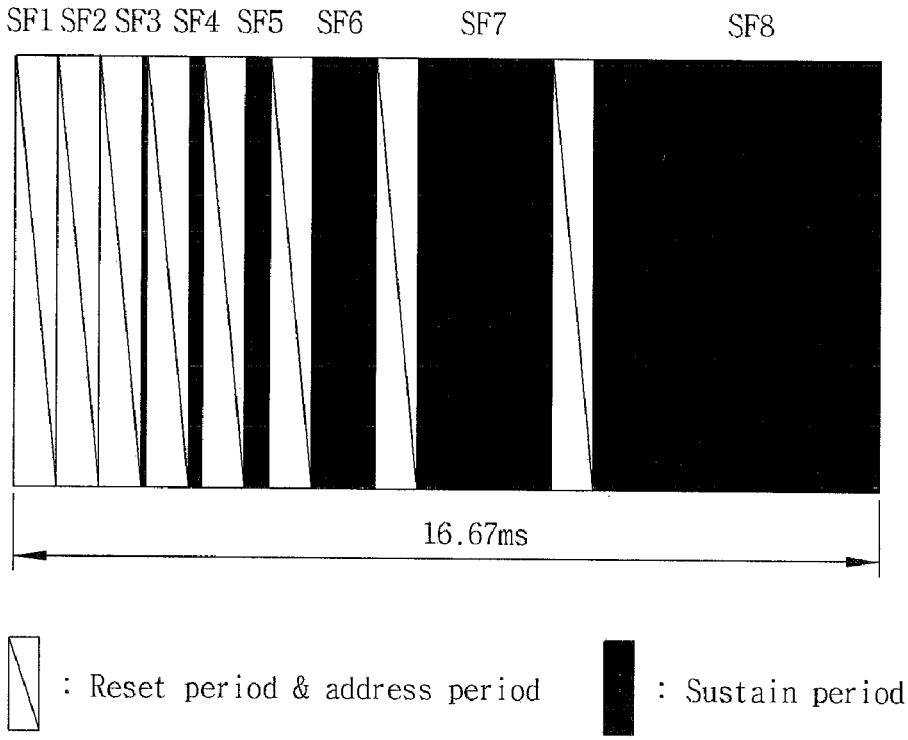
Fig. 1 Related Art
FIG. 1 diagrammatically illustrates an image gradation processing method performed by a plasma display panel.
Figure 2:
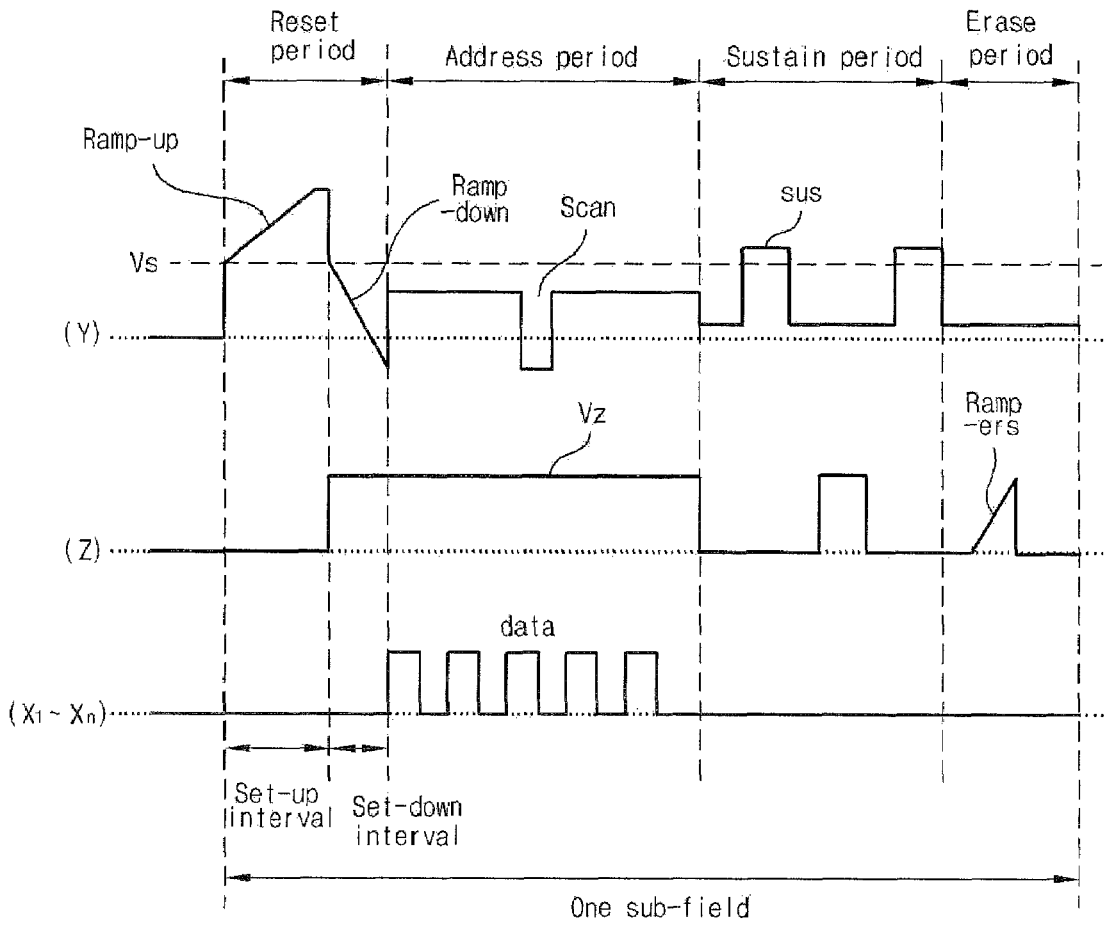
Fig. 2 Related Art
FIG. 2 shows a plasma display panel driving waveform.
Figure 3:
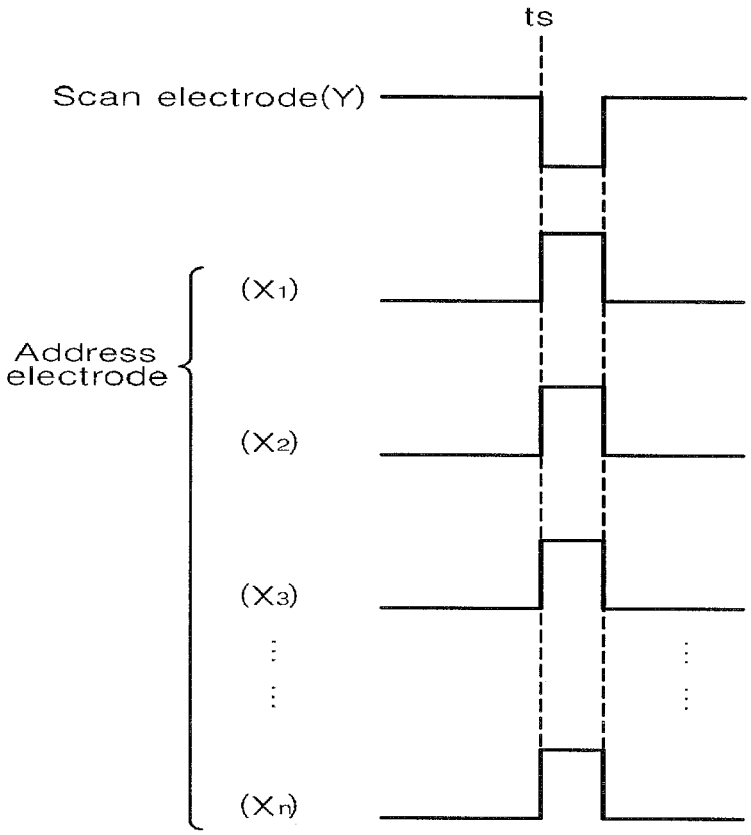
Fig. 3 Related Art
FIG. 3 diagrammatically shows a timing chart of signals applied in the address period, according to a driving method for a plasma display panel.
Figure 4:
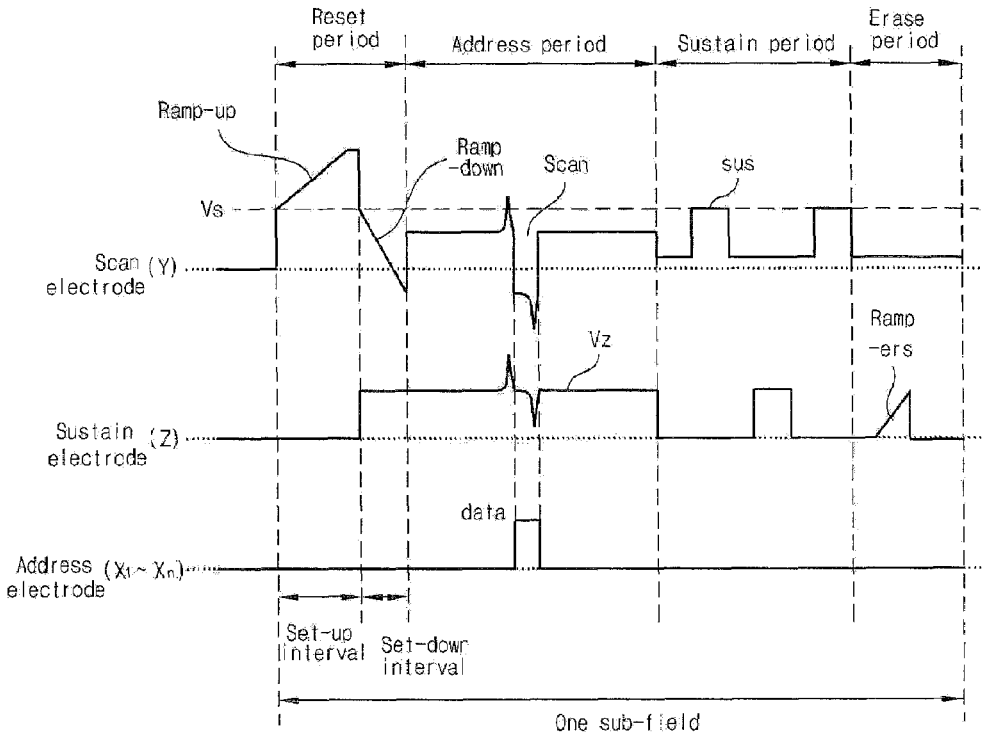
Fig. 4 Related Art
FIG. 4 is an explanatory diagram of the generation of noises by signals applied during an address period, according to a driving method for a plasma display panel.
Figure 5:
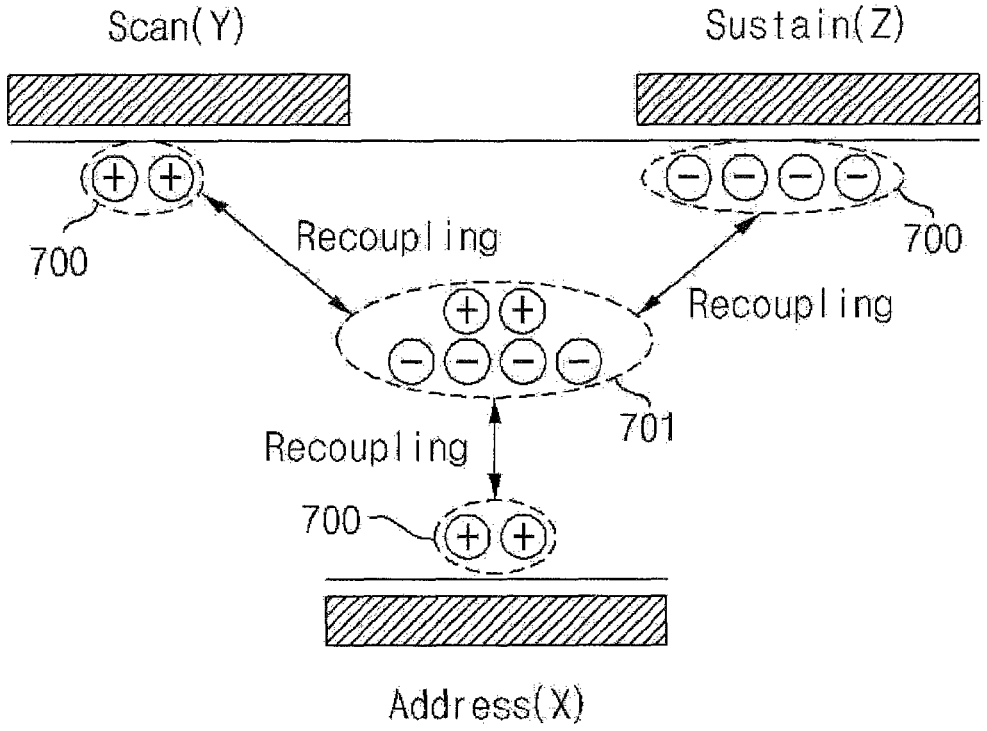
Fig. 5 Related Art
FIG. 5 is an explanatory diagram of a high-temperature erroneous discharge in a plasma display panel driven by a driving waveform.
Figure 6:
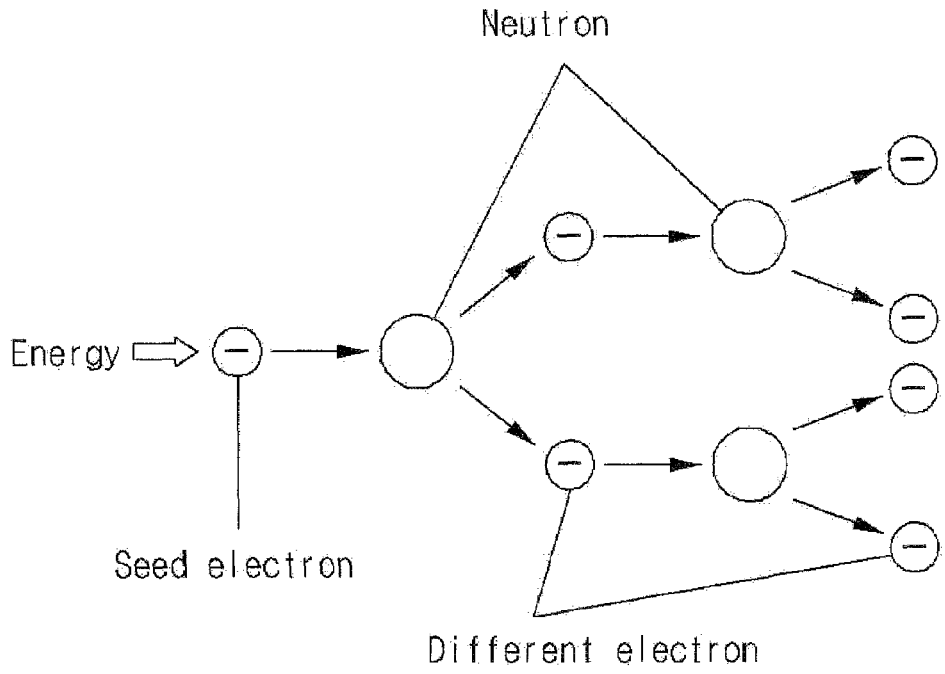
Fig. 6 Related Art
FIG. 6 is an explanatory diagram of a low-temperature erroneous discharge in a plasma display panel driven by a driving waveform.
Figure 7:
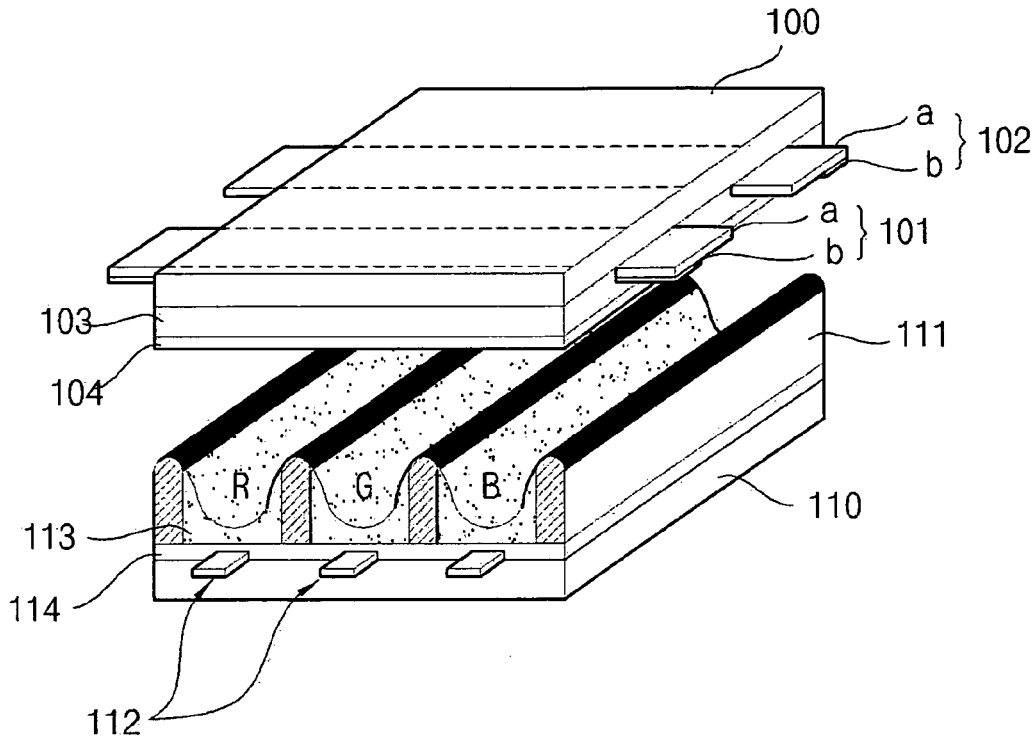
FIG. 7 illustrates the structure of a plasma display panel.

FIG. 7 is an illustration of a plasma display panel structure. The plasma display panel includes a front substrate 100 where a plurality of sustain electrode pairs, each pair including a scan electrode 102 and a sustain electrode 101 formed on a front glass 100 on which an image is displayed. A plurality of address electrodes 112 are arranged to intersect with the sustain electrode pairs is attached in parallel to a rear glass substrate 110, which is a predetermined distance apart from the front substrate 100.

A scan electrode 102 and a sustain electrode 101 form a pair of electrodes for generating discharge in one discharge cell and maintaining luminescence of the cell. As shown in FIG. 7, the scan electrode 102 and the sustain electrode 101 include a transparent electrode (a) made of (Indium-Tin-Oxide) ITO and a bus electrode (b) made of metallic materials. The scan electrode 102 and the sustain electrode 101 limits discharge current, and are covered by at least one upper dielectric layer 103 insulating between electrode pairs. On the surface of the upper dielectric layer 103 is a protective layer 104 on which a magnesium oxide (MgO) thin film is deposited to facilitate discharge conditions. As can be appreciated, the scan and sustain electrode may be implemented using one layer and the layers 103 and 104 can be implemented using one layer.

The rear substrate 110 including a plurality of discharge spaces, e.g., stripe type (or wall type) barrier ribs or partitions 112 for forming discharge cells are arranged in parallel in the direction of the address electrodes 112. Alternatively, the barrier ribs or partition may also extend in the direction of the scan/sustain electrodes. In addition, a plurality of address electrodes 112 for performing address discharge and generating ultraviolet rays are arranged parallel to the barrier ribs 112. The upper surface of the rear substrate 110 is coated with RGB fluorescent substances, e.g., phosphor, 113 emitting visible rays for image display during address discharge. A lower dielectric layer 114 for protecting the address electrodes 112 is formed between the address electrodes 112 and the fluorescent substances 113.

Figure 8:
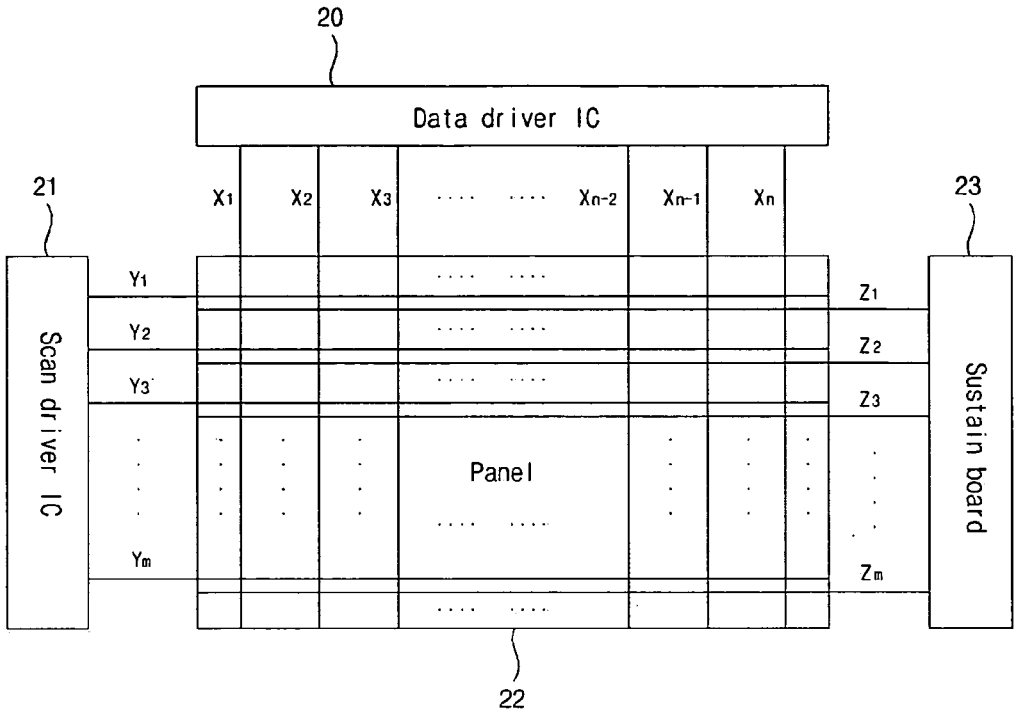
FIG. 8 diagrammatically illustrates the coupling relation between a plasma display panel and a drive module.

In the plasma display panel, a plurality of discharge cells are formed in a matrix arrangement, and a drive module including a drive circuit provides a predetermined signal to the discharge cells. FIG. 8 is an illustration of the coupling relation between the plasma display panel and the drive module. The drive module includes data driver IC (Integrated Circuit) 20 as a data driver, a scan driver IC 21 as a scan driver, and a sustain board 23 as a sustain driver.

The plasma display panel 22 receives a video signal from the outside and performs a predetermined signal processing, to receive a data signal outputted from the data driver IC 20, a scan signal and a sustain signal outputted from the scan driver IC 21, and a sustain signal outputted from the sustain board 23, respectively. Among a plurality of cells of the plasma display panel 22 having received the data, scan and sustain signals, discharge occurs only in a cell selected by the scan signal. Then, this selected cell is irradiated to a predetermined brightness. Here, the data driver IC 20 outputs a predetermined data signal to every data electrode $X_1$-$X_n$ through a connecting part, such as a FPC (Flexible Printed Circuit) (not shown).

Figure 9:
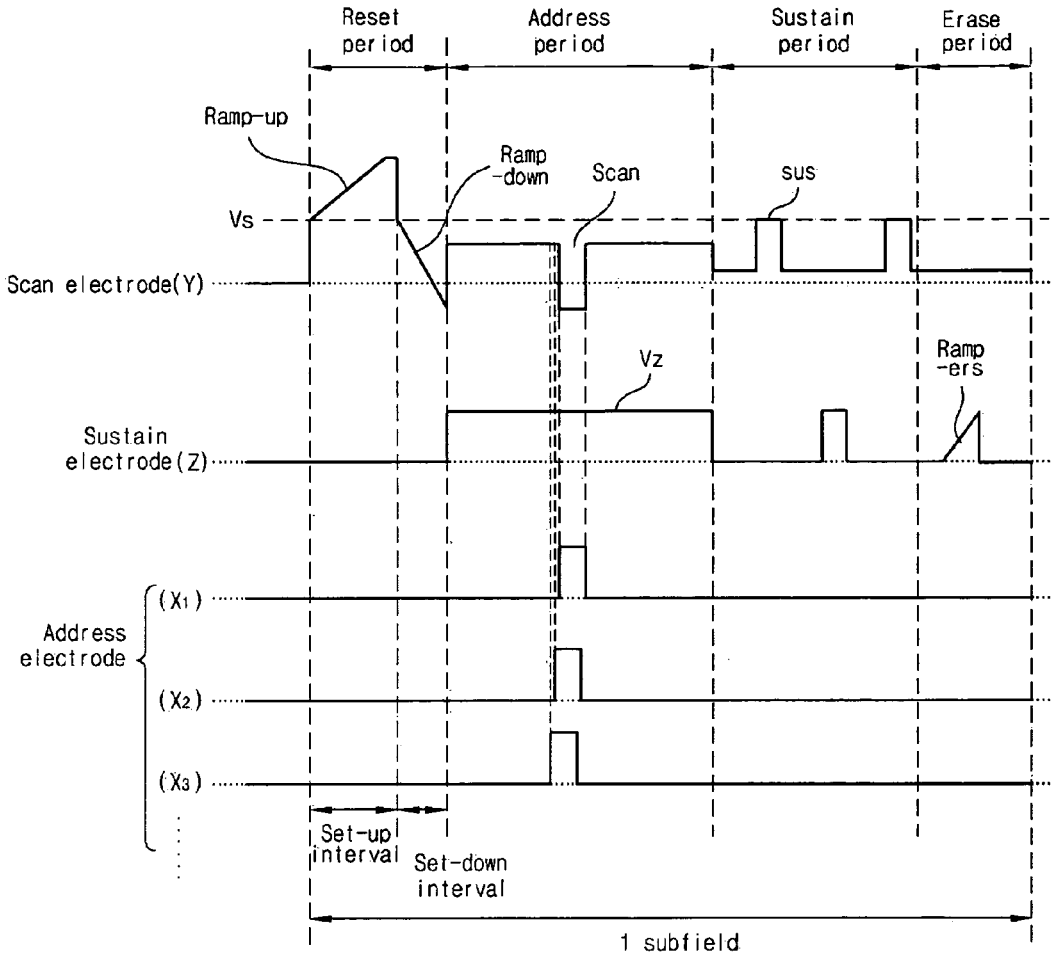
FIG. 9 illustrates a driving waveform for explaining a driving method of a plasma display panel according to an embodiment of the present invention.

FIG. 9 is an illustration of a driving waveform for explaining a driving method of a plasma display panel according to an embodiment of the present invention. In an address period of one subfield, data signal timings for all the address electrodes $X_1$-$X_n$ are different from a scan signal timing for a corresponding or selected scan electrode, and a signal voltage provided to the sustain electrode and the address electrodes during a set-down interval of the reset period is set to a ground level (GND). The different timings for the data signals relative to the scan signal and holding the signal voltage of the sustain electrode during the set-down interval to the ground level (GND) prevent the change of a waveform being applied to the scan electrode caused by the coupling between a signal applied to the scan electrode and a signal applied to the sustain electrode. Hence, an operational margin can be secured stably.

There are various ways to differentiate application timings of the scan signal to the scan electrode and the data signals to the address electrodes $X_1$-$X_n$, one of which is to make every data signal applied to the address electrodes $X_1$-$X_n$ to be at different timings from that of the scan signal. FIG. 10*a* to FIG. 10*g* are detailed scan signal and data signal timing charts in a driving waveform of the plasma display panel according to the embodiment of the present invention. As shown in FIGS. 10*a*-10*g*, in an address period of one subfield, every data signal is applied to the address electrodes $X_1$-$X_n$ at different timings from a scan signal applied to the scan electrode Y.

Figure 10A:
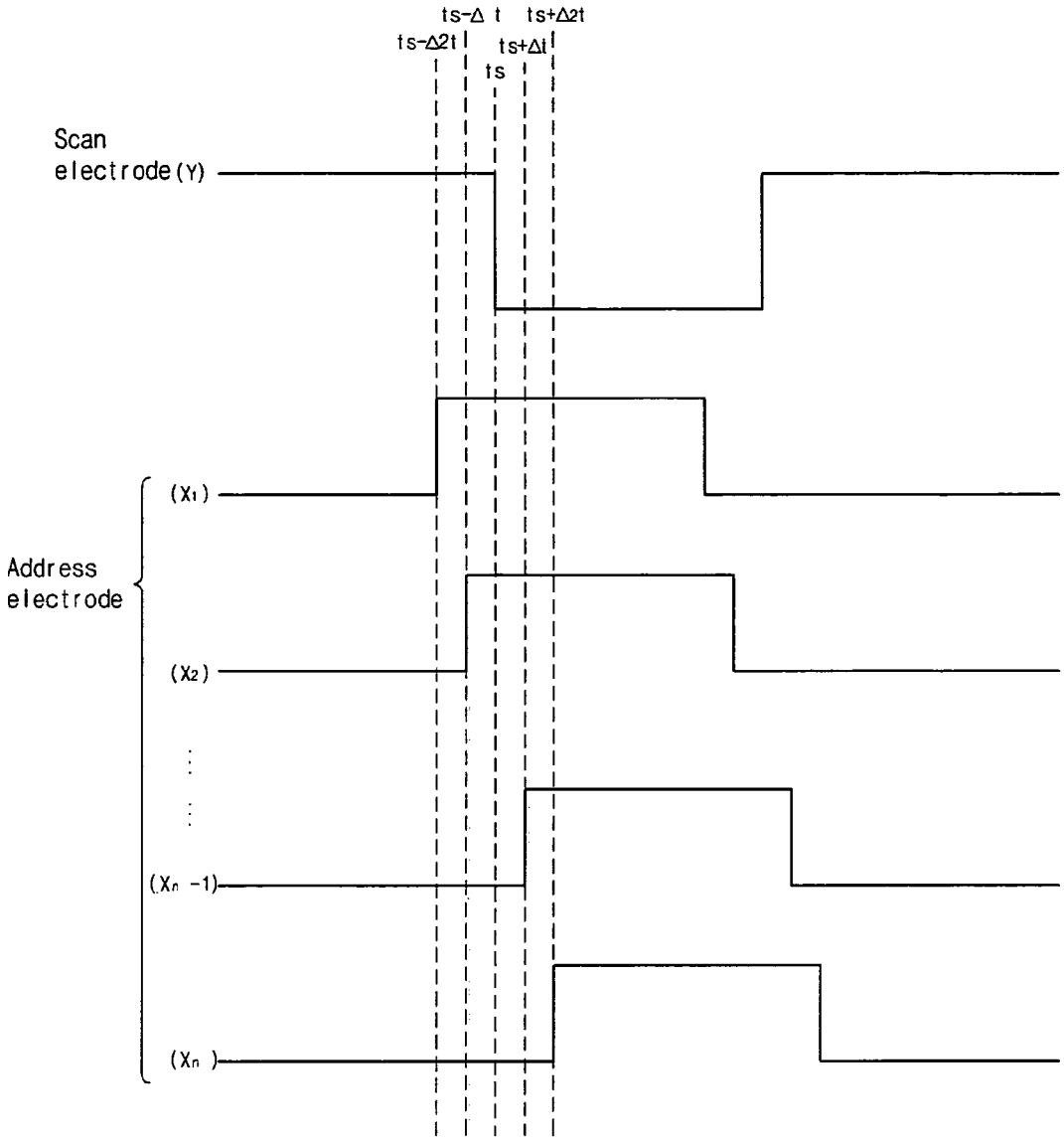
FIG. 10*a* to FIG. 10*g* are scan signal and data signal timing charts in a driving waveform of the plasma display panel according to embodiments of the present invention.

As shown in FIG. 10*a*, suppose that the scan signal is applied to the scan electrode Y at 'ts'. According to the arrangement sequence of the address electrodes $X_1$-$X_n$, the address electrode X1, for example, receives a data signal 2Δt earlier than the point when the scan signal is applied to the scan electrode Y, i.e., the data signal is applied to the address electrode $X_1$ at ts−2Δt. In a similar manner, the address electrode $X_2$ receives a data signal Δt earlier than the point when the scan signal is applied to the scan electrode Y, i.e., the data signal is applied to the address electrode $X_2$ at ts−Δt. An address electrode $X(_{n-1})$ receives a data signal at ts+Δt, and an address electrode $X_n$ receives a data signal at ts+2Δt. In other words, the data signals are applied to the address electrodes $X_1$-$X_n$ before or after the application timing of the scan signal to the scan electrode Y.

Figure 10B:
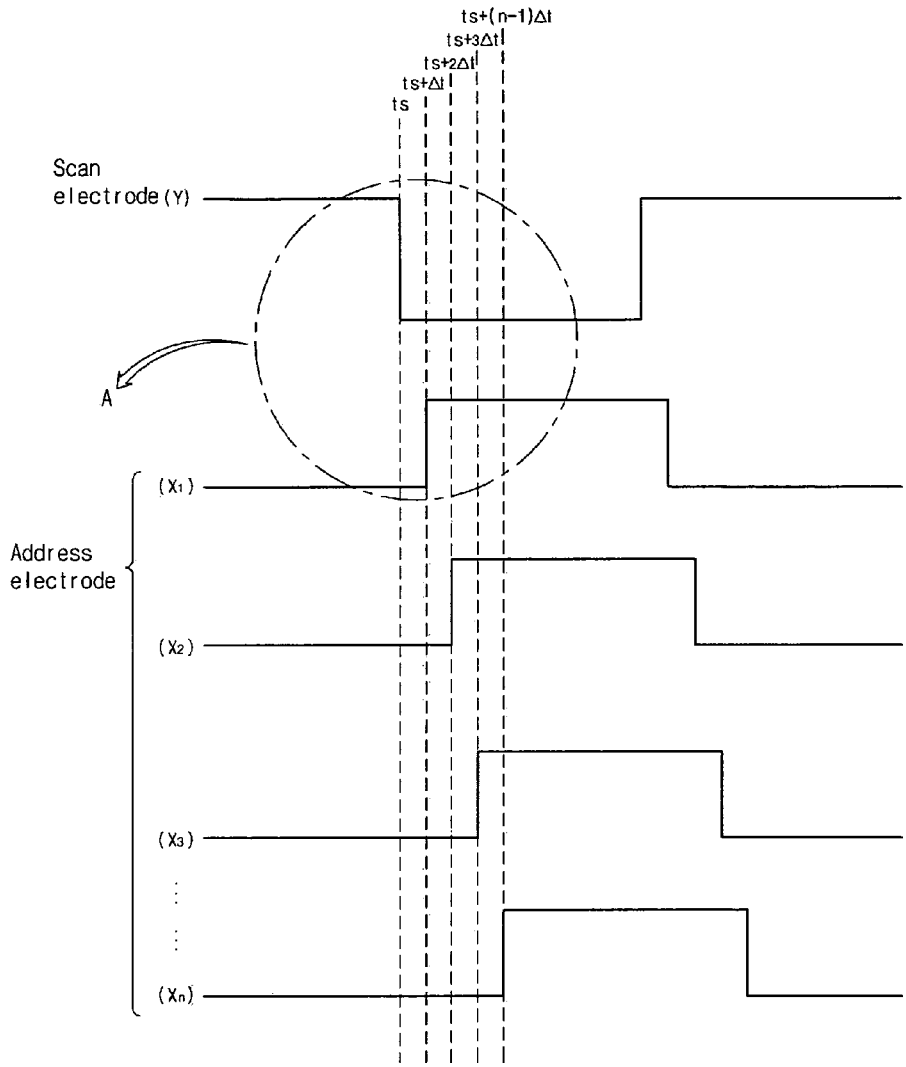

Slightly different from the method illustrated in FIG. 10*a*, it is also possible to set data signal(s) to be applied to at least one address electrodes $X_1$-$X_n$ after the scan signal is applied to the scan electrode, as illustrated in FIG. 10*b*. The driving waveform of FIG. 10*b* is different from the driving waveform of FIG. 10*a* although data signals in both driving waveforms are applied at different timings from that of the scan signal. In particular, all the data signals are applied later than the scan signal. As previously indicated, it is also possible to set only one data signal, instead of setting all the data signals, to be applied after the application timing of the scan signal. That is, the number of data signals to be applied later than the application timing of the scan signal can vary.

For instance, as shown in FIG. 10*b*, suppose that the scan signal is applied to the scan electrode Y at 'ts'. Then, according to the arrangement sequence of the address electrodes $X_1$-$X_n$, the address electrode $X_1$, for example, receives a data signal Δt later than the point when the scan signal is applied to the scan electrode Y, i.e., the data signal is applied to the address electrode $X_1$ at ts+Δt. Similarly, the address electrode $X_2$ receives a data signal 2Δt later than the point when the scan signal is applied to the scan electrode Y, i.e., the data signal is applied to the address electrode $X_2$ at ts+2Δt. An address electrode $X_3$ receives a data signal at ts+3Δt, and an address electrode $X_n$ receives a data signal at ts+nΔt. In other words, all the data signals are applied to the address electrodes $X_1$-$X_n$ after the scan signal is applied to the scan electrode Y.

Figure 10C:
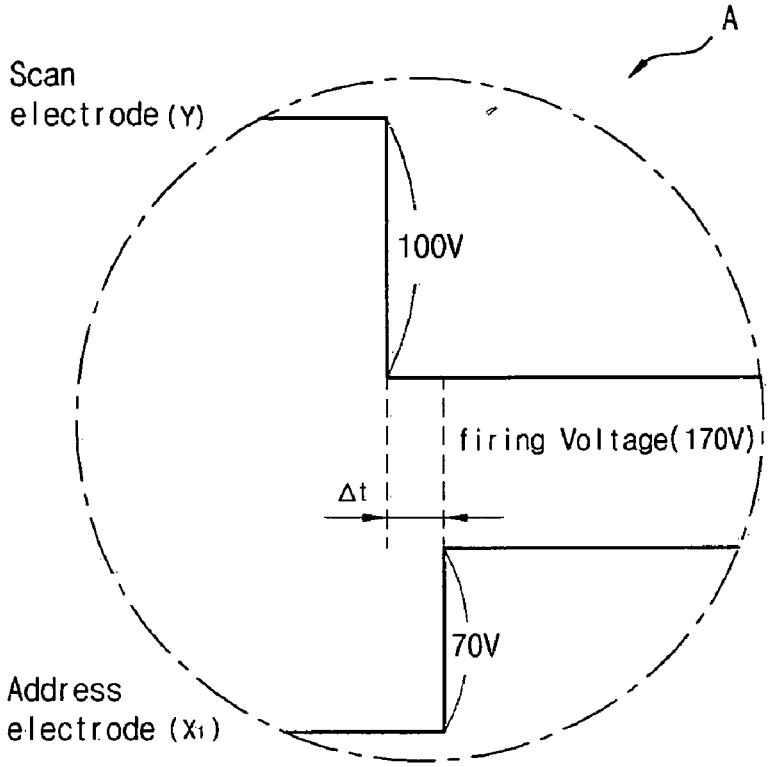

An area A (an exploded view is shown in FIG. 10*c*) in the driving waveform of FIG. 10*b* shows the occurrence of discharge. In the area A, it was assumed that an address discharge firing voltage or voltage difference is 170V, a scan signal voltage is 100V, and a data signal voltage is 70V. By the scan signal being applied first to the scan electrode Y, the voltage difference between the scan electrode Y and the address electrodes $X_1$ becomes 100V. However, by the data signal being applied to the address electrode $X_1$ after the delay of Δt from the point when the scan signal is applied to the scan electrode, the voltage difference between the scan electrode Y and the address electrode $X_1$ increased up to 170V. Hence, this voltage difference between the scan electrode Y and the address electrode $X_1$ becomes an address discharge firing voltage, and an address discharge is generated between the scan electrode Y and the address electrode $X_1$.

Figure 10D:
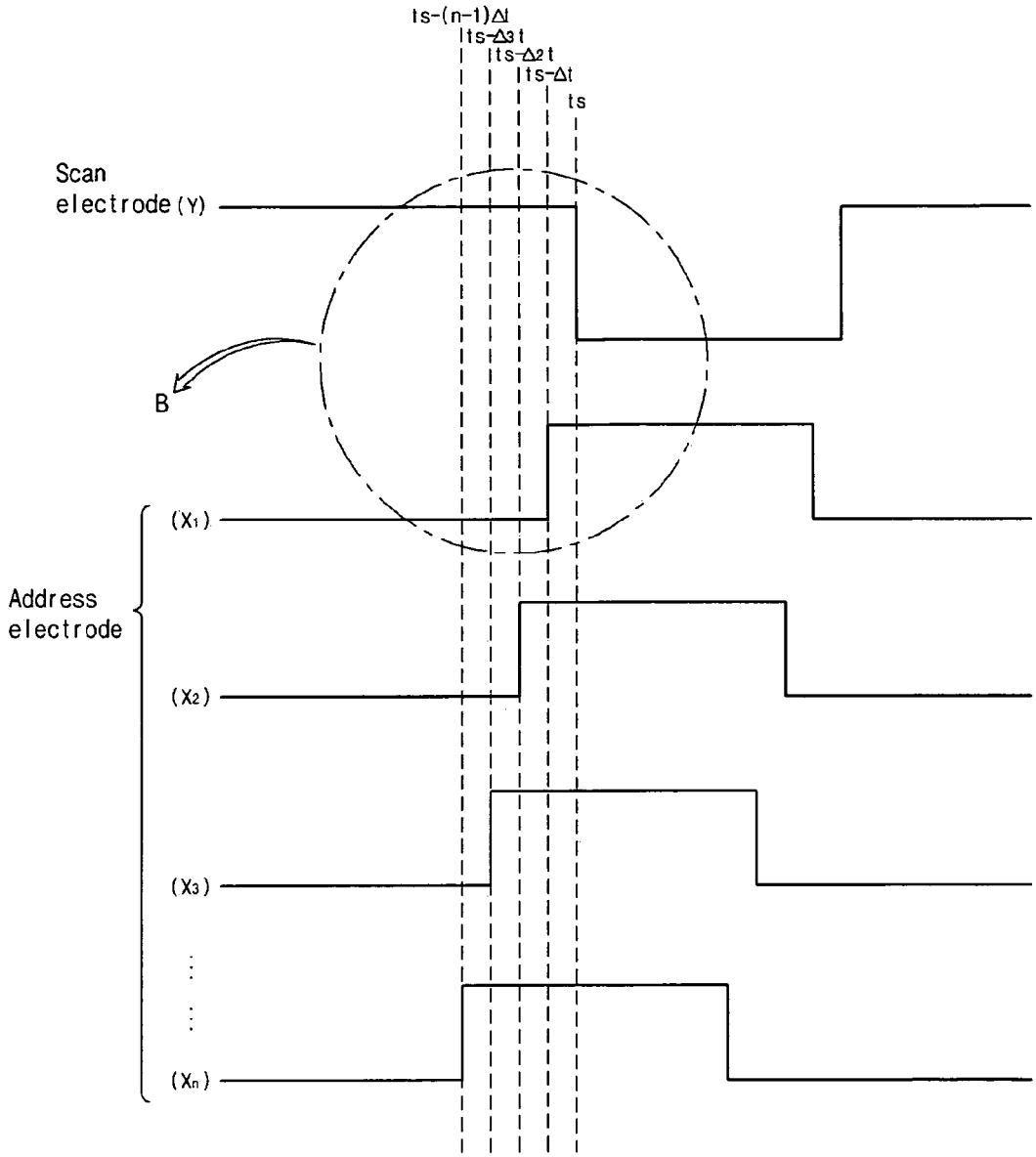

Differently from the method illustrated in FIG. 10*b*, it is also possible to set all the data signals to be applied earlier than the scan signal, as illustrated in FIG. 10*d*. Unlike the driving waveforms shown in FIG. 10*a* and FIG. 10*b*, the driving waveform of FIG. 10*d* illustrates another case in which all the data signals are applied to the address electrodes $X_1$-$X_n$ at different timings, more specifically, earlier than the application timing of the scan signal. Although FIG. 10*d* illustrates a case in which all the data signals are applied earlier than the scan signal, it is also possible to set only one data signal to be applied before the scan signal. In other words, the number of data signals to be applied before the scan signal can vary.

For instance, as depicted in FIG. 10*d*, suppose that the scan signal is applied to the scan electrode Y at 'ts'. According to the arrangement sequence of the address electrodes $X_1$-$X_n$, the address electrode $X_1$, for example, receives a data signal Δt earlier than the point when the scan signal is applied to the scan electrode Y, i.e., the data signal is applied to the address electrode $X_1$ at ts−Δt. Similarly, the address electrode $X_2$ receives a data signal 2Δt earlier than the point when the scan signal is applied to the scan electrode Y, i.e., the data signal is applied to the address electrode $X_2$ at ts−2Δt. In this manner, an address electrode $X_3$ receives a data signal at ts−3Δt, and an address electrode $X_n$ receives a data signal at ts−nΔt. In other words, all the data signals are applied to the address electrodes $X_1$-$X_n$ before the scan signal is applied to the scan electrode Y.

Figure 10E:
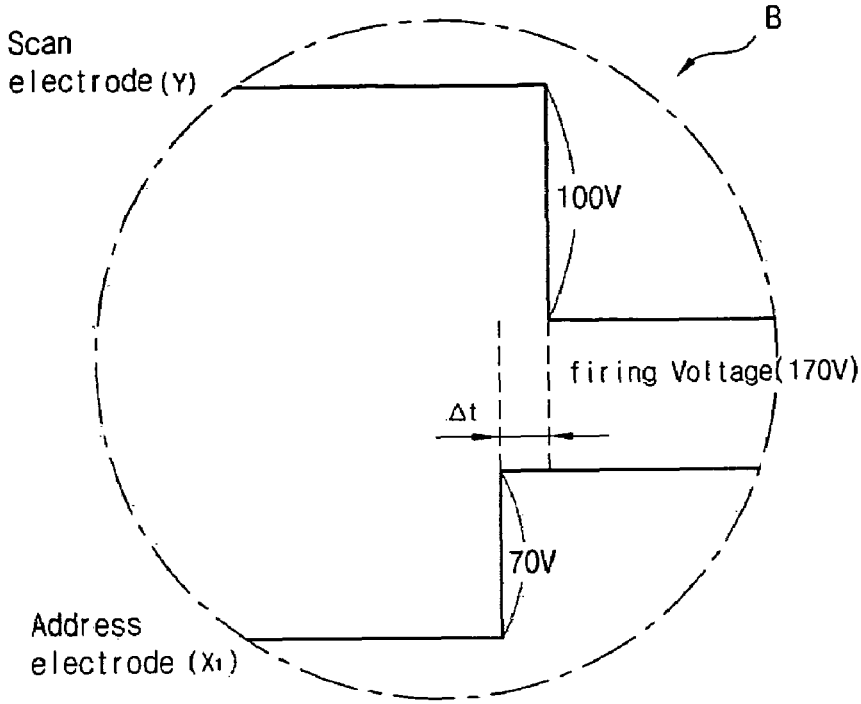

An area B (an exploded view is shown in FIG. 10*e*) in the driving waveform of FIG. 10*d* shows the occurrence of discharge. In the area B, it was assumed that an address discharge firing voltage or voltage difference is 170V, a scan signal voltage is 100V, and a data signal voltage is 70V, similar to FIG. 10*c*. By the data signal being applied first to the address electrode $X_1$, the voltage difference between the scan electrode Y and the address electrodes $X_1$ becomes 70V. However, by the scan signal being applied to the scan electrode Y after the delay of Δt from the point when the data signal is applied to the address electrode $X_1$, the voltage difference between the scan electrode Y and the address electrode $X_1$ increased up to 170V. Therefore, this voltage difference between the scan electrode Y and the address electrode $X_1$ becomes an address discharge firing voltage, and an address discharge is generated between the scan electrode Y and the address electrode $X_1$.

In FIGS. 10*a*-10*e*, the timing difference between the scan signal applied to the scan electrode Y and the data signals applied to the address electrodes $X_1$-$X_n$, or the timing difference between the data signals applied to the address electrodes $X_1$-$X_n$ has been explained using Δt, which can be considered as the offset timing or time difference. For instance, the application timing of the scan signal to the scan electrode Y was set at 'ts', and the application timing difference between the scan signal and its closest data signal was set to Δt. In this way, the application timing difference between the scan signal and the second closest data signal from the scan signal was set to 2Δt. Here, the value of Δt remains constant.

In other words, although the data signals are applied to the address electrodes $X_1$-$X_n$ at different timings from the application timing of the scan signal to the scan electrode Y, the application timing difference between data signals is uniformly set. However, in one subfield, it is also possible to differentiate or unify the application timing difference between the scan signal and its closest data signal, while fixing the application timing difference between the data signals applied to each of the address electrodes $X_1$-$X_n$ at a constant value.

For example, if the application timing difference between the scan signal and its closest data signal in an address period of a subfield is set to Δt, it is possible to set the application timing difference between the scan signal and its closest data signal in another address period of the same subfield to 2Δt. Considering the limited amount of time given to the address period, it may be preferable to set the application timing difference between the scan signal and its closest data signal in a range from 10 ns to 1000 ns. In addition, considering a scan signal width according to the operation of the plasma display panel, it may be preferable to set Δt in a range from 1/100 to 1 time(s) of a predetermined scan signal width. For instance, suppose that the width of a scan signal is 1 μs. Then, the signal application timing difference should be between 1/100 times of 1 μs, i.e., 10 ns, and 1 μs, i.e., 1000 ns (10 ns≦Δt≦1000 ns).

Further, it is possible to differentiate the application timing difference between data signals, while keeping the data signal application timings different from the scan signal application timing. In other words, it is possible to set the application timings of the data signals to the address electrodes $X_1$-$X_n$ to be different from the application timing of the scan signal to the scan electrode Y, and at the same time, it is possible to set the data signal application timings to be different from one another. Suppose that the scan signal is applied to the scan electrode Y at 'ts', and the application timing difference between the scan signal and its closest data signal is Δt. This application timing difference between the scan signal and its closest data signal can be set to 3Δt, instead of Δt.

For instance, if ts=0 ns, the data signal is applied to the address electrode $X_1$ at 10 ns. Therefore, the timing difference between the scan signal applied to the scan electrode Y and the data signal applied to the address electrode $X_1$ is 10 ns. The next data signal is applied to the address electrode $X_2$ at 20 ns, meaning that the timing difference between the scan signal applied to the scan electrode Y and the data signal applied to the address electrode $X_2$ is 20 ns. Hence, the timing difference between the data signal applied to the address electrode $X_1$ and the data signal applied to the address electrode $X_2$ equals to 10 ns.

Meanwhile, another data signal is applied to the address electrode $X_3$ at 40 ns. Namely, the timing difference between the scan signal applied to the scan electrode Y and the data signal applied to the address electrode $X_3$ is 40 ns, and the timing difference between the data signal applied to the address electrode $X_2$ and the data signal applied to the address electrode $X_3$ is 20 ns. In this way, it is possible to set the application timings of the data signals to the address electrodes $X_1$-$X_n$ to be different from the application timing of the scan signal to the scan electrode Y, and set the data signal application timings to be different from one another at the same time.

In such an instance, it is preferable to set the timing difference between the scan signal applied to the scan electrode Y and the data signals applied to the address electrodes $X_1$-$X_n$ in a range between 10 ns and 1000 ns. In addition, considering a scan signal width according to the operation of the plasma display panel, it is preferable to set Δt in a range from 1/100 to 1 time(s) of a predetermined scan signal width.

Figure 10F:
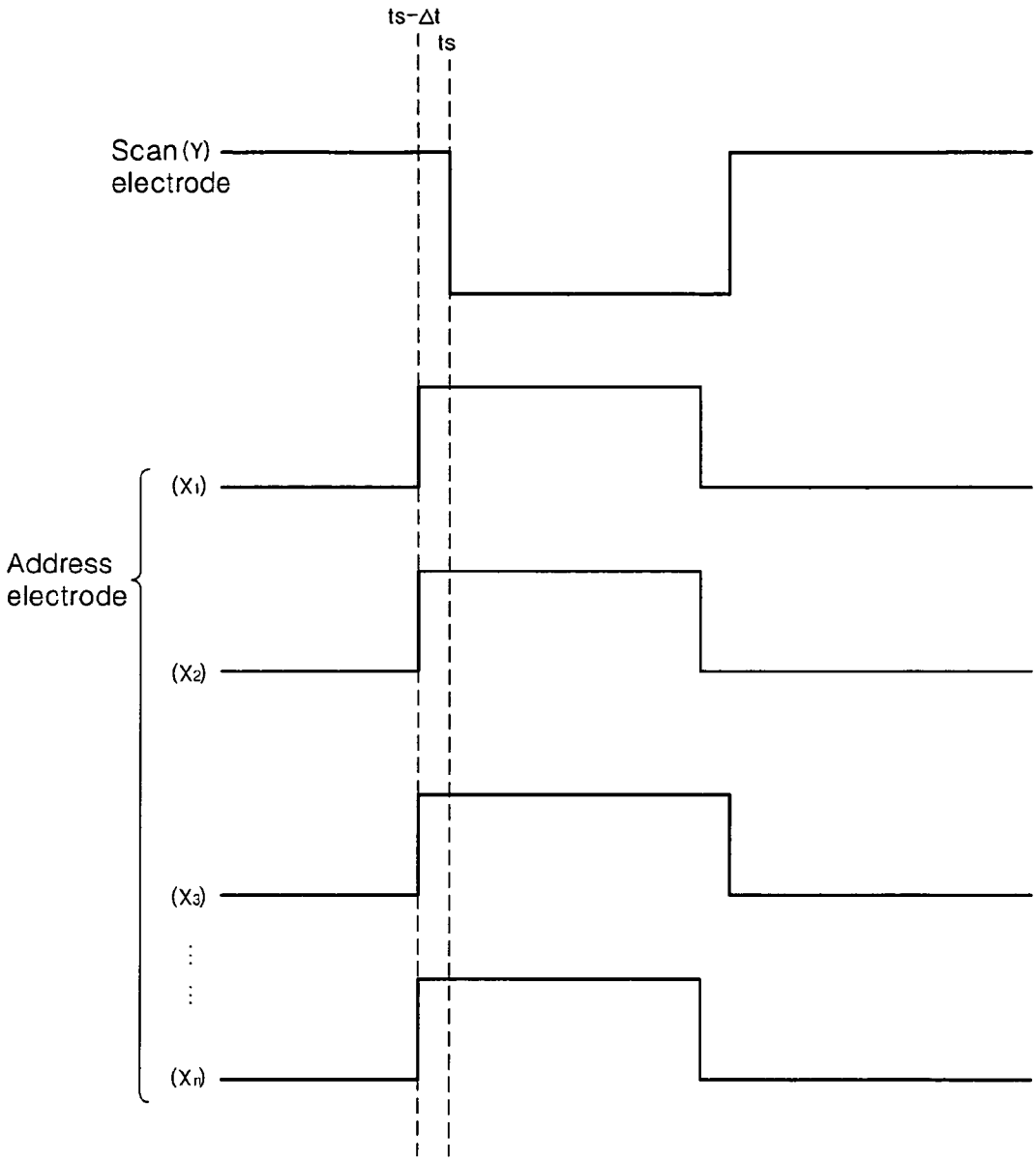
Figure 10G:
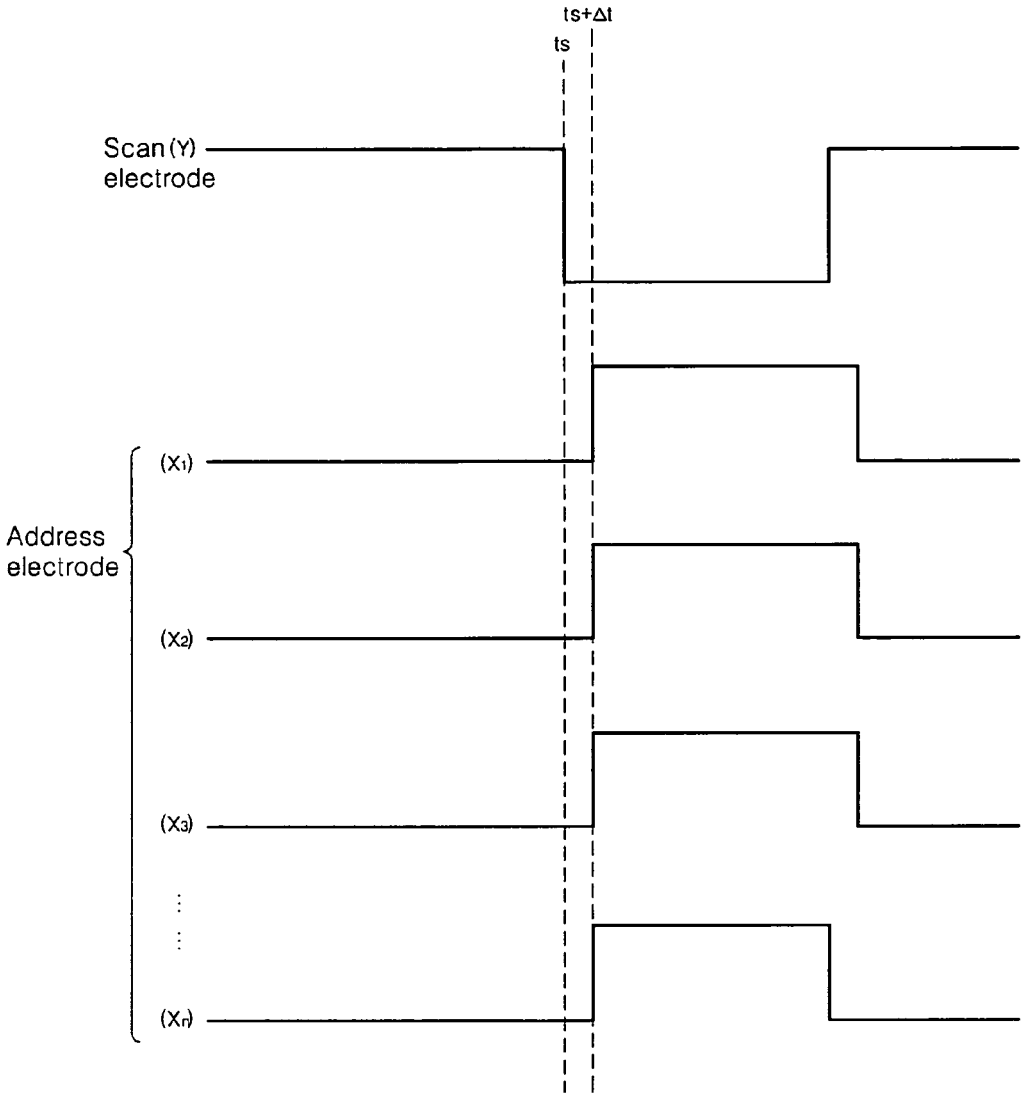

Still another method for differentiating signal timings is illustrated in FIG. 10*f*. In this driving waveform, the scan signal is applied to the scan electrode Y at 'ts', and the data signals are applied to all of the address electrodes $X_1$-$X_n$ Δt earlier than the scan signal application timing, i.e., at ts−Δt. Yet another method for differentiating signal timings is illustrated in FIG. 10*g*. In this driving waveform, the scan signal is applied to the scan electrode Y at 'ts', and the data signals are applied to all of the address electrodes $X_1$-$X_n$ Δt later than the scan signal application timing, i.e., at ts+Δt.

Therefore, when the scan signal and the data signals are applied to the scan signal Y and the address electrodes $X_1$-$X_n$, respectively, at different timings from one another, it becomes possible to reduce coupling through the capacitance of the panel at each timing for the application of data signals to the address electrodes $X_1$-$X_n$. Consequently, it becomes possible to reduce noises of waveforms being applied to the scan electrode and the sustain electrode.

Figure 11A:
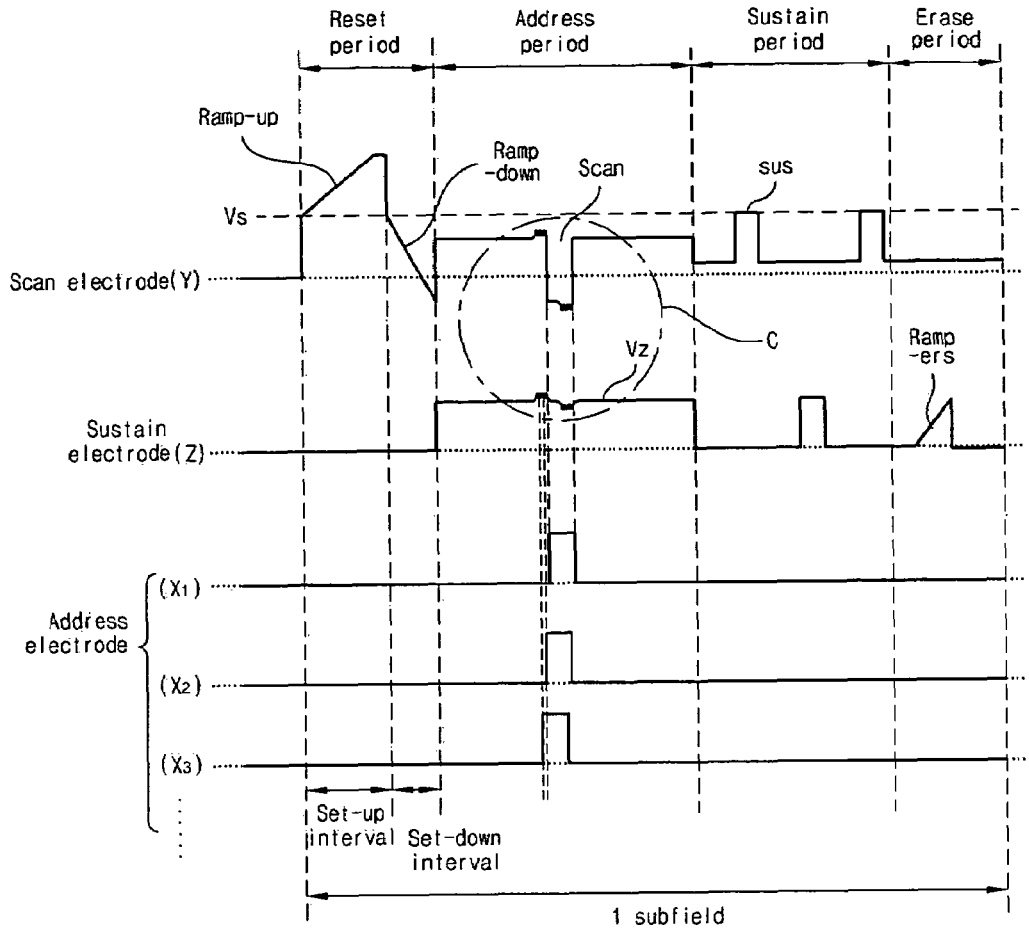
FIG. 11*a* to FIG. 11*b* diagrammatically explain how noises are reduced by a driving waveform of the plasma display panel according to the embodiment of the present invention.
Figure 11B:
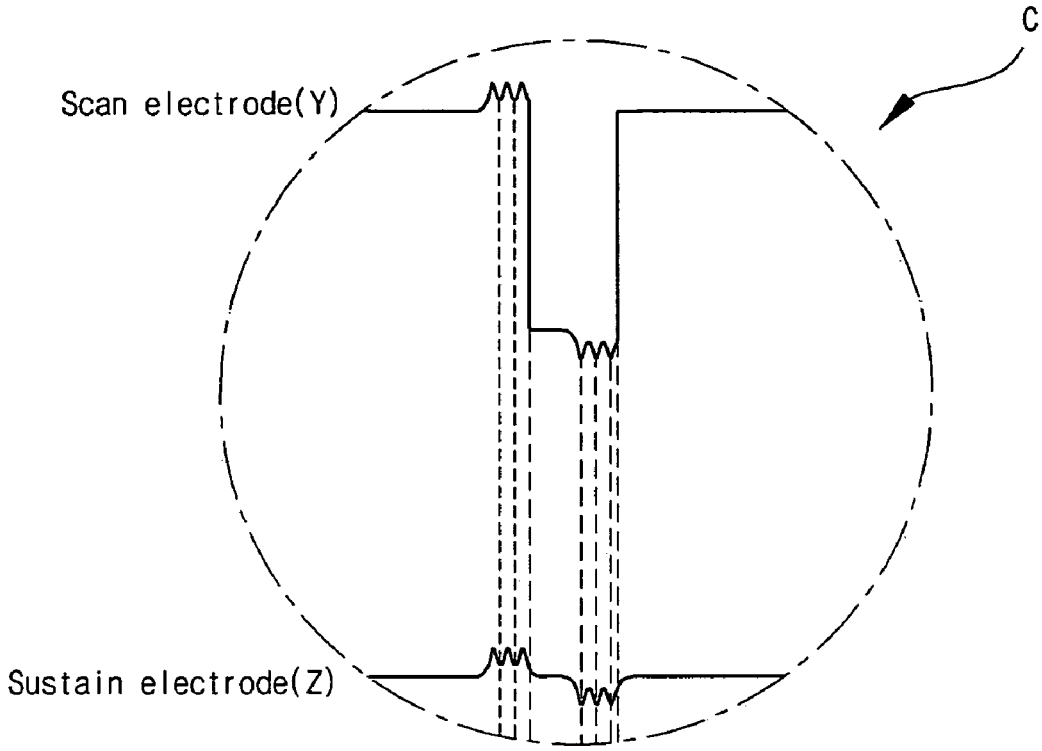

FIG. 11*a* to FIG. 11*b* are illustrations for explaining how noises are reduced by a driving waveform of the plasma display panel according to the embodiment of the present invention. As shown in FIG. 11*a*, a considerable amount of noises is reduced from the waveforms being applied to the scan electrode and the sustain electrode. FIG. 11*b* is an exploded view of an area C of FIG. 11*a* to elaborate such phenomenon. The noises were reduced because the data signals were not applied to the address electrodes $X_1$-$X_n$ at the same timing with the point when the scan signal is applied to the scan electrode Y. In other words, by differentiating the data signal application timings from the scan signal application timing, coupling through capacitance of the panel at each timing was reduced.

At a point when a data signal rapidly rises, rising noises in the waveforms applied to the scan electrode and the sustain electrode were reduced. Likewise, at a point when a data signal rapidly falls, falling noises in the waveforms applied to the scan electrode and the sustain electrode were also reduced. Hence, the address discharge generated in the address period are stabilized, and further the operation efficiency of the plasma display panel are enhanced.

Further, by maintaining the signal voltages provided to the sustain electrode and the address electrodes during the set-down interval of the reset period at the ground level (GND), the coupling rate between the signal applied to the scan electrode and the signal applied to the sustain electrode can be decreased to thereby prevent changes in a waveform being applied to the scan electrode. In this manner, it becomes possible to secure the operational margin more stably. By stabilizing the address discharge of the plasma display panel, the entire panel can be scanned through one driver (this is called a single scan method), e.g., one scan driver and/or one data driver.

Figure 12:
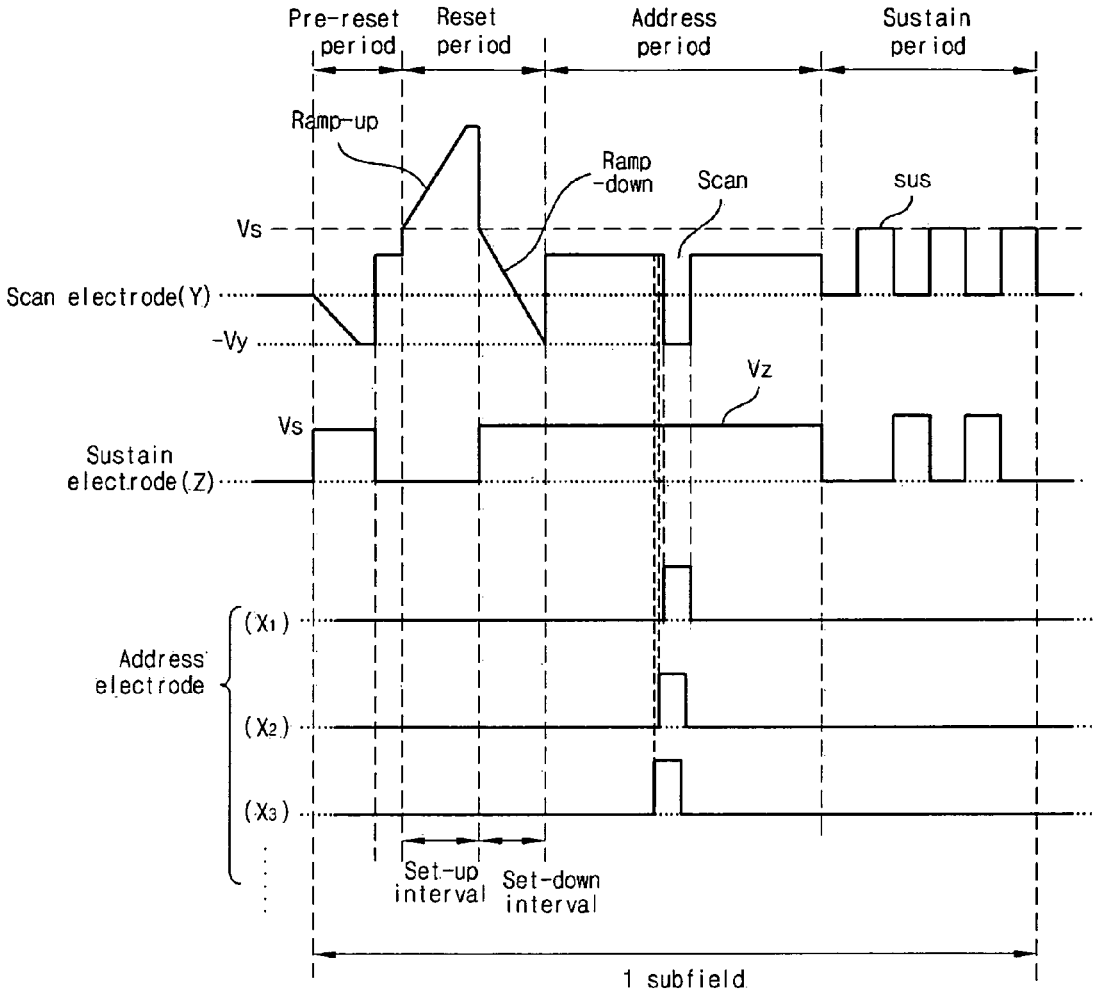
FIG. 12 shows another example of a driving waveform for explaining a driving method of the plasma display panel according to another embodiment of the present invention.

FIG. 12 is an illustration for explaining another example of a driving waveform driving method of the plasma display panel. In FIG. 12, a pre-reset period is added before a reset period. The pre-reset period is preferably only in a specific subfield among a plurality of subfields, e.g., first subfield of a frame.

In the pre-reset period, positive charges are accumulated on the scan electrode within a discharge cell, and negative charges are accumulated on the sustain electrode within a discharge cell. In the pre-reset period, a ramp waveform characterized of a gradually changing voltage is applied to at least one of the scan electrode and the sustain electrode. In other words, the ramp waveform can be applied to only the scan electrodes, or only to the sustain electrodes, or to both.

To accumulate positive charges on the scan electrode and negative charges on the sustain electrode during the pre-reset period, it is preferable to provide a negative voltage to the scan electrode and a positive voltage to the sustain electrode. If this is seen from the perspective of the ramp waveform, a falling ramp waveform (Ramp-down) characterized of a gradually falling negative voltage is applied to the scan electrode, or a rising ramp waveform (Ramp-up) characterized of a gradually rising positive voltage is applied to the sustain electrode.

Figure 13:
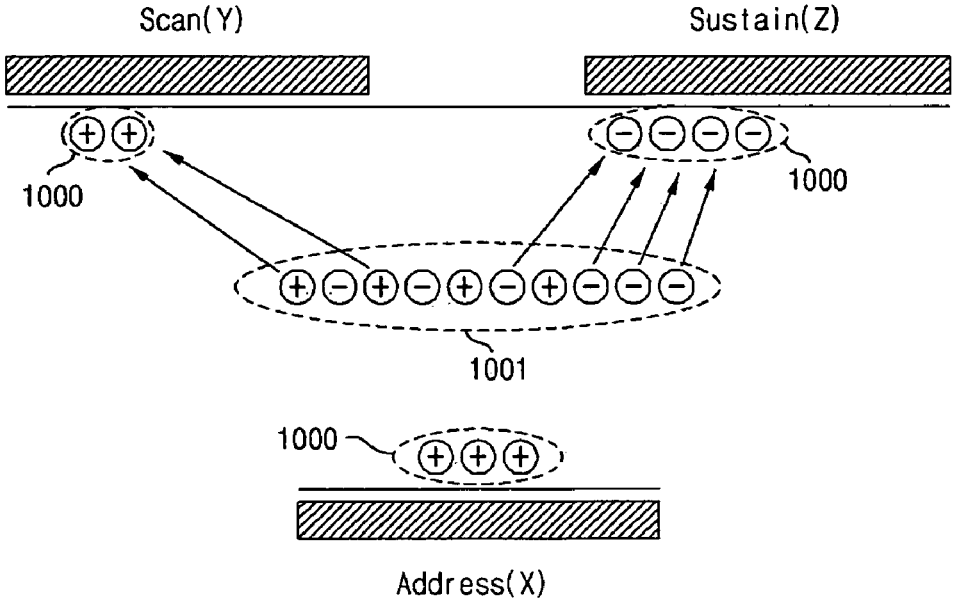
FIG. 13 diagrammatically explains how space charges are changed by the driving waveform of FIG. 12.

In the pre-reset period, the negative voltage is provided to the scan electrode and the positive voltage is provided to the sustain electrode, so that the amount of space charges within a discharge cell can be reduced. This phenomenon is depicted in FIG. 13. When a negative voltage is provided to the scan electrode Y and a positive voltage is provided to the sustain electrode Z during the pre-reset period, many space charges 1001 that do not participate in discharge within the discharge cell are drawn onto the scan electrode Y or the sustain electrode Z. These space charges 1001 acted as wall charges 1000 on the scan electrode Y or on the sustain electrode Z. The absolute amount of space charges 1001 is reduced, and the amount of wall charges 1000 located on a predetermined electrode within the discharge cell is increased.

Although the ambient temperature of the panel may be relatively high, the amount of wall charges 1000 within the discharge cell is sufficient. In other words, even through the temperature around the panel is relatively high, since the rate (or possibility) of recoupling or recombination between space charges 1001 and wall charges 1000 that did not participate in discharge within the discharge cell is relatively low, the absolute amount of wall charges 1000 is not reduced. Thus, the high-temperature erroneous discharge is prevented.

In addition, when a negative voltage is provided to the scan electrode Y and a positive voltage is provided to the sustain electrode Z during the pre-reset period, the amount of wall charges 1000 within the discharge cell is increased. Therefore, although the ambient temperature of the panel is relatively low and the plasma discharge mechanism slows down, the absolute amount of the wall charges was increased, and the low-temperature erroneous discharge is prevented.

Because of easiness in control, a falling ramp waveform (Ramp-down) is preferably used for the negative voltage being provided to the scan electrode Y during the pre-reset period. Further, the positive voltage provided to the sustain electrode Z preferably has a fixed voltage value. The slope of the falling negative voltage (Ramp-down) provided to the scan electrode can be adjusted. For example, if it is necessary to attract space charges faster and stronger, the slope can be made steeper, i.e., the falling time may be shortened. The waveforms of the negative voltage and the positive voltage provided to the scan electrode Y and the sustain electrode Z, respectively, can be modified. For instance, a negative voltage having a constant voltage can be applied to the scan electrode Y, and Ramp-up can be provided to the sustain electrode Z.

In this embodiment, the negative voltage of the falling ramp waveform Ramp-down being applied to the scan electrode Y was set to fall from the ground level (GND) to a predetermined voltage. It is preferable to made the negative voltage of the falling ramp waveform Ramp-down being applied to the scan electrode Y fall to the lower limit of the signal voltage provided to the scan electrode Y during the address period. In other words, the predetermined voltage to which the negative voltage of the falling ramp waveform Ramp-down being provided to the scan electrode Y is equal to the lower limit of the scan signal voltage being provided to the scan electrode during the address period.

By equalizing the lower limit of the negative voltage of the falling ramp waveform Ramp-down to the lower limit of the scan signal voltage being provided to the scan electrode Y during the address period, a driving waveform based on the present invention driving method of a plasma display panel can be achieved, without adding a separate driving voltage supply (not shown). The positive voltage applied to the sustain electrode Z is preferably a sustain voltage Vs that is applied in the sustain period.

By including the pre-reset period between the sustain period of a previous subfield and the reset period of a subsequent subfield for accumulating wall charges, and providing the negative voltage to the scan electrode Y and the positive voltage to the sustain electrode Z in the pre-reset period, positive wall charges are accumulated on the scan electrode Y within the discharge cell, and negative wall charges are accumulated on the sustain electrode Z within the discharge cell. It becomes possible to reduce the voltage of the rising ramp waveform Ramp-up of a reset signal during the set-up interval of the reset period. Further, the rising ramp waveform Ramp-up provided during the set-up interval of the reset period takes part in accumulating wall charges within the discharge cell.

Since a certain amount of wall charges is already accumulated in the pre-reset period even before the rising ramp waveform Ramp-up is applied, and although the magnitude of the rising ramp waveform is small, a sufficient amount of wall charges required for the set-up is accumulated within the discharge cell. As such, it becomes possible to reduce the rising ramp waveform Ramp-up in the reset period, and the occurrence of the high-temperature erroneous discharge and/or the low-temperature erroneous discharge can be reduced.

Figure 14:
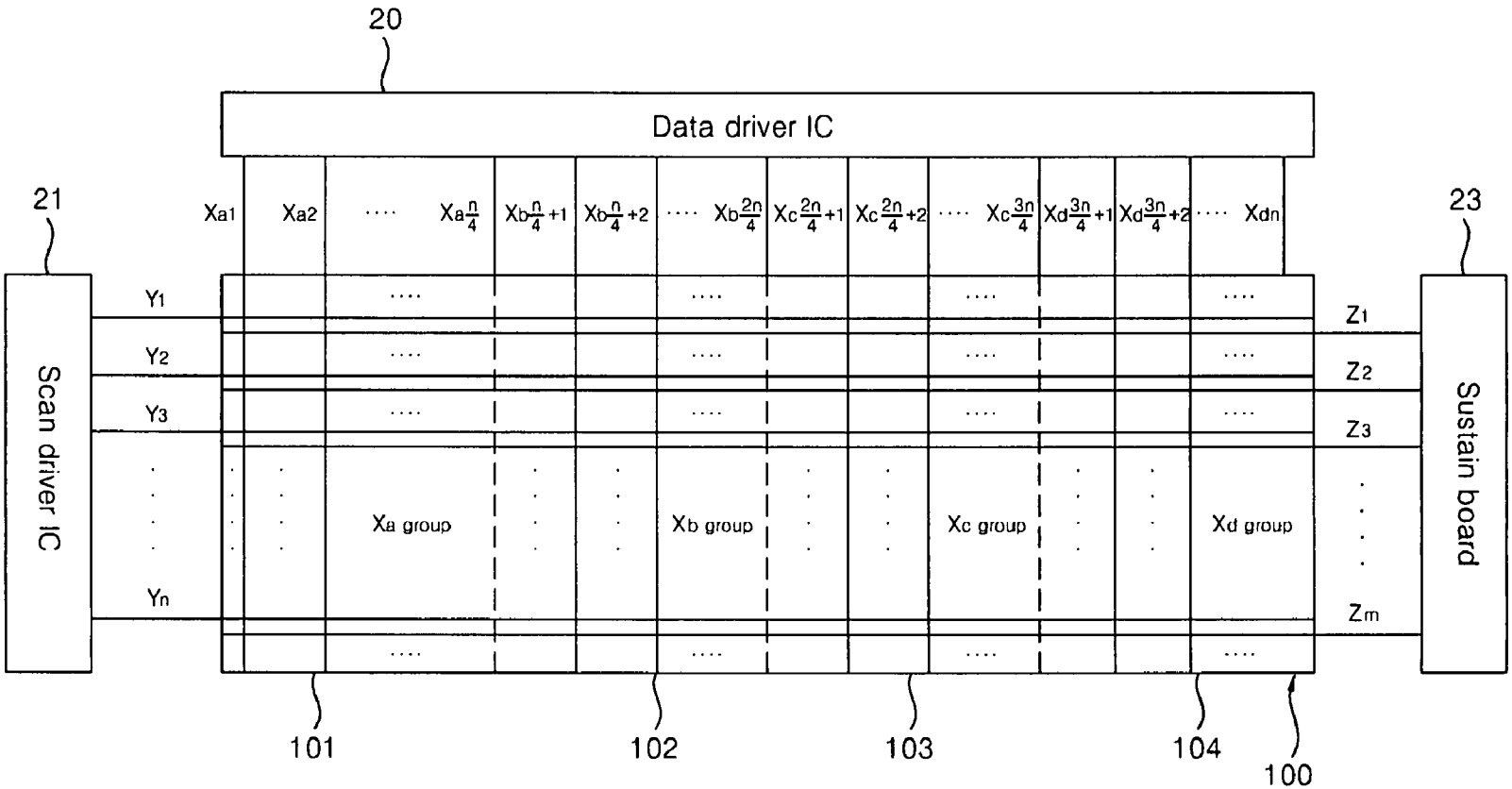
FIG. 14 is an explanatory diagram for a driving method based on electrode group division for use in the plasma display panel according to another embodiment of the present invention.

According to the previous embodiment of the driving waveform of the plasma display panel, the data signals are applied to the address electrodes $X_1$-$X_n$ at different timings than the scan signal being applied to the scan electrode. It is also possible to apply at least one of the data signals concurrently to 2–(n–1) address electrodes. FIG. 14 is an explanatory diagram for a driving method based on electrode group division for use in the plasma display panel according to an embodiment of the present invention.

Referring to FIG. 14, address electrodes $X_1$-$X_n$ of a plasma display panel 100 are divided into Xa electrode group ($Xa_1$-$Xa_{(n)/4}$) 101, Xb electrode group ($Xb_{(n/4+1)}$-$Xb_{(2n)/4}$) 102, Xc electrode group ($Xc_{(2n/4+1)}$-$XC_{(3n)/4}$) 103, and Xd electrode group ($Xd_{(3n/4+1)}$-$Xd_{(n)}$) 104. A data signal is applied to at least one of these address electrode groups at a different timing from the scan signal application timing. Even though all of the electrodes ($Xa_1$-$Xa_{(n)/4}$) in the Xa electrode group 101 receive data signals at different timings from the point when the scan signal is applied to the scan electrode Y, the data signals are applied to the electrodes ($Xa_1$-$Xa_{(n)/4}$) in the Xa electrode group 101 concurrently.

Further, for the other electrodes in the electrode groups 102, 103 and 104, data signals are applied at different timings from the data signal application timing for the electrodes ($Xa_1$-$Xa_{(n)/4}$) in the Xa electrode group 101. The application timings of the data signals to the electrodes in other address electrode groups 102, 103 and 104 can be coincident with or different from the scan signal application timing.

In the embodiment illustrated in FIG. 14, it was assumed that each address electrode group 101, 102, 103 and 104 has the same number of address electrodes. However, both the number of address electrodes and the number of address electrode groups can be adjusted. In effect, the number of address electrode groups, N, is preferably in a range of $2 \leqq N \leqq (n-1)$, wherein n is a total number of address electrodes.

Comparing the embodiment of the address electrode group of FIG. 14 to that of FIG. 9, the address electrodes $X_1$-$X_n$ of the plasma display panel are divided into a plurality of address electrode groups, each address electrode group including one address electrode in FIG. 9.

FIG. 14 illustrates the structure of the panel 100, in which a data driver IC is a data driver, a scan driver IC is a scan driver, and a sustain board is a sustain driver, which are spaced apart from the panel by a predetermined distance, respectively. The data driver IC, the scan driver IC and the sustain board are connected respectively to the address electrodes, the scan electrode and the sustain electrode. However, the data driver IC, the scan driver IC and the sustain board can be connected with the panel 100 as well.

Figure 15A:
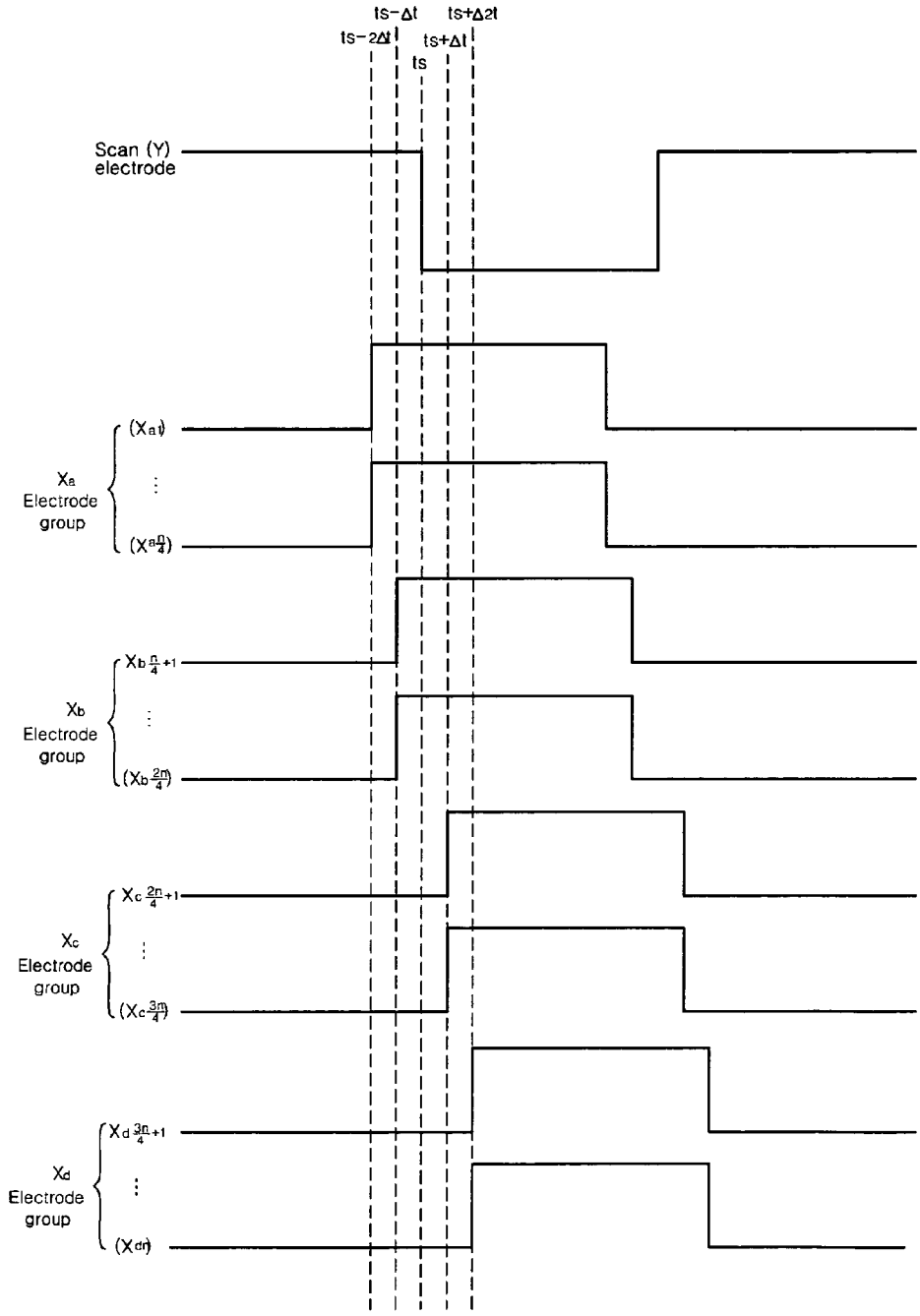
FIG. 15*a* to FIG. 15*c* are scan signal and data signal timing charts based on electrode group division for the plasma display panel according to the embodiment of the present invention.
Figure 15B:
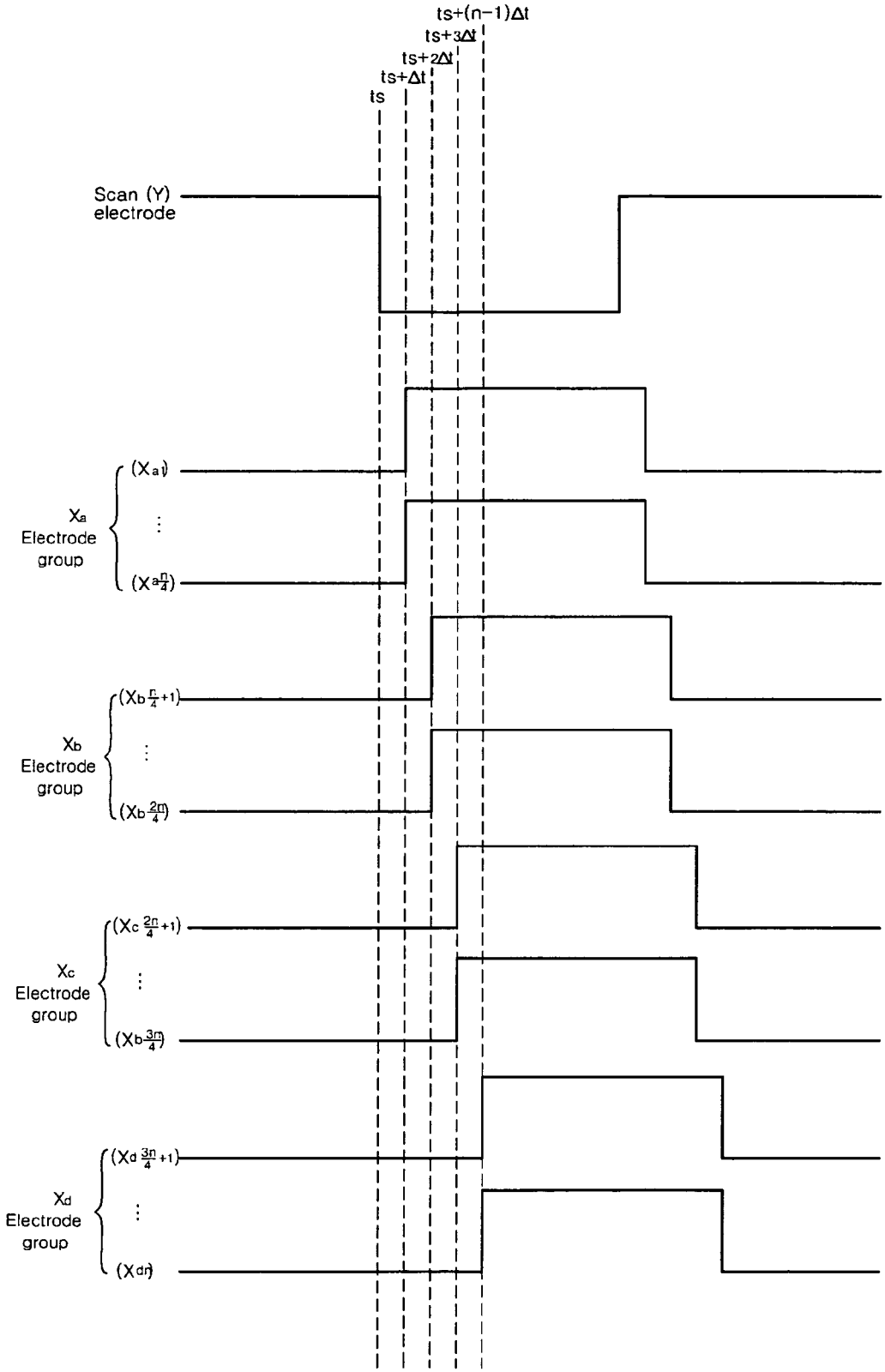
Figure 15C:
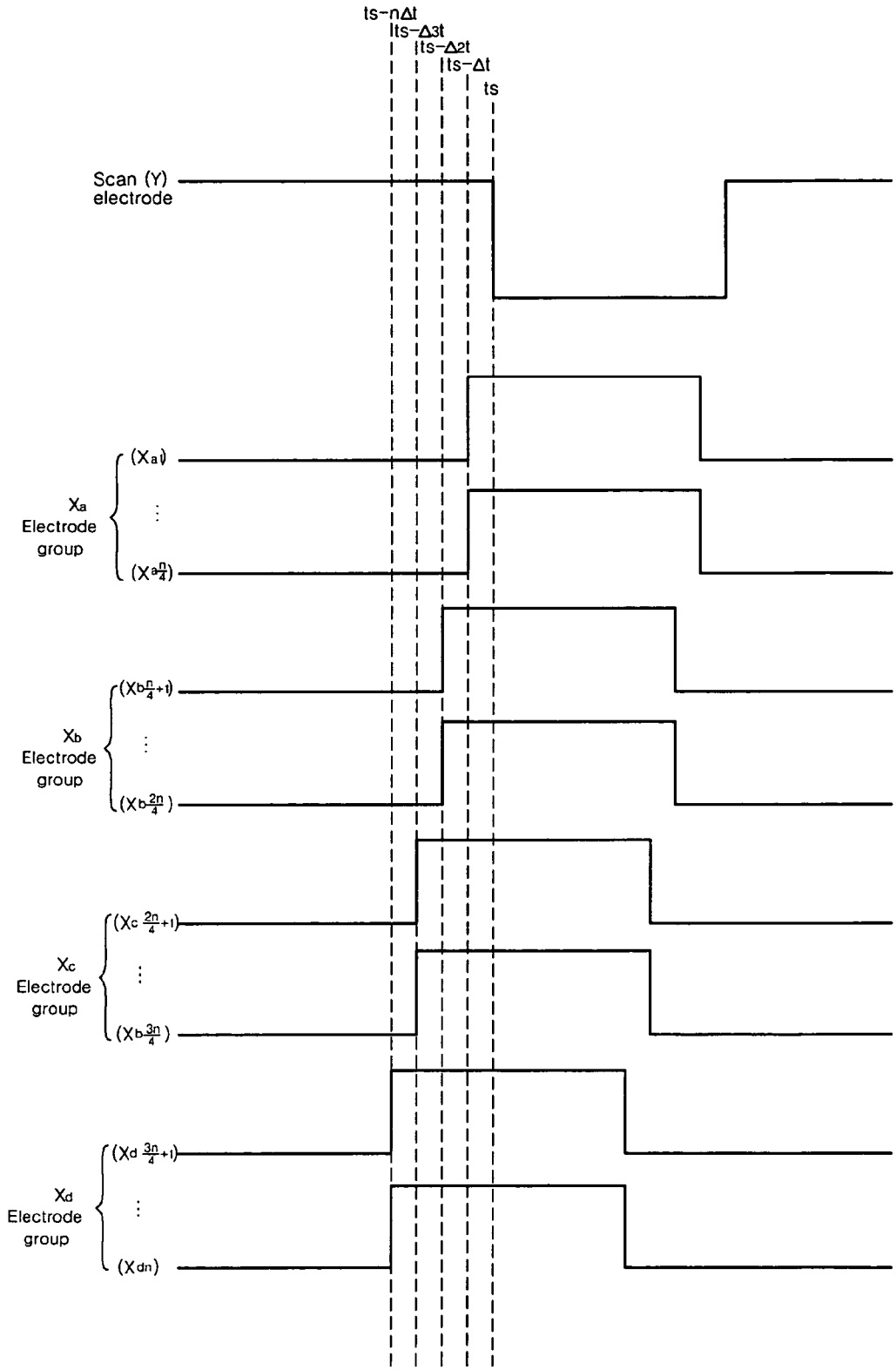

FIG. 15*a* to FIG. 15*c* are scan signal and data signal timing charts based on electrode group division for the plasma display panel according to an embodiment of the present invention. A plurality of address electrodes $X_1$-$X_n$ are divided into a plurality of address electrode groups Xa electrode group, Xb electrode group, Xc electrode group and Xd electrode group, as in FIG. 14 and, in an address period of the subfield, data signals are applied to the address electrodes $X_1$-$X_n$ of at least one address electrode group at different timings from that of the scan signal being applied to the scan electrode Y. A signal voltage provided to the sustain electrode and the address electrodes during the set-down interval of the reset period is maintained at the ground level (GND).

The different timings for the data signals and the scan signal and holding the signal voltage during the set-down interval to the ground level (GND) of the sustain signal prevent the change of a waveform being applied to the scan electrode caused by the coupling between a signal applied to the scan electrode and a signal applied to the sustain electrode. Hence, an operational margin can be secured stably.

For example, as shown in FIG. 15*a*, suppose that the scan signal is applied to the scan electrode Y at 'ts'. Then, according to the arrangement sequence of the address electrode groups including address electrodes $X_1$-$X_n$, the address electrodes ($Xa_1$-$Xa_{(n)/4}$) in the Xa electrode group, for example, receive data signals 2Δt earlier than the point when the scan signal is applied to the scan electrode Y, i.e., the data signals are applied at ts−2Δt. Similarly, the address electrodes ($Xb_{(n/4+1)}$-$Xb_{(2n)/4)}$ in the Xb electrode group receive data signals Δt earlier than the point when the scan signal is applied to the scan electrode Y, i.e., the data signals are applied at ts−Δt. The address electrodes ($Xc_{(2\,n/4+1)}$-$Xc_{(3n/4)}$-$Xc_{(3n)/4}$) in the Xc electrode group receive data signals at ts+Δt, and the address electrodes ($Xd_{(3n/4+1)}$ 4-$Xd_{(n)}$) in the Xd electrode group receive data signals at ts+2Δt. The data signals are applied to the each of the electrode groups Xa, Xb, Xc and Xd, each group including address electrodes $X_1$-$X_n$, before or after the application timing of the scan signal to the scan electrode Y.

Different from the method illustrated in FIG. 15*a*, it is also possible to set data signals to be applied to at least one address electrode group after the scan signal is applied to the scan electrode, as illustrated in FIG. 15*b*. All the data signals are applied later than the scan signal. It is also possible to set only one address electrode group, instead of setting all the address electrode groups, to receive data signals after the application timing of the scan signal. Further, the number of address electrode groups receiving data signals later than the application timing of the scan signal can vary.

For instance, as shown in FIG. 15*b*, suppose that the scan signal is applied to the scan electrode Y at 'ts'. According to the arrangement sequence of the address electrode groups including the address electrodes $X_1$-$X_n$, respectively, the address electrodes in the electrode group Xa receive data signals Δt later than the point when the scan signal is applied to the scan electrode Y, i.e., the data signals are applied at ts+Δt. Similarly, the address electrodes in the electrode group Xb receive data signals 2Δt later than the point when the scan signal is applied to the scan electrode Y, i.e., the data signals are applied at ts+2Δt. The address electrodes in the electrode group Xc receive data signals at ts+3Δt, and the address electrodes in the electrode group Xd receive data signals at ts+4Δt, respectively. In other words, as shown in FIG. 15*b*, all the data signals are applied to the address electrodes $X_1$-$X_n$ in every address electrode group after the scan signal is applied to the scan electrode Y.

Different from the method illustrated in FIG. 15*b*, it is also possible to set all the data signals to be applied to the address electrodes $X_1$-$X_n$ in every address electrode group earlier than the scan signal, as illustrated in FIG. 15*c*. The driving waveform of FIG. 15*d* illustrates another case in which all the data signals are applied to the address electrodes $X_1$-$X_n$ in the address electrode groups at different timings, more specifically, earlier than the application timing of the scan signal. Although FIG. 15*c* illustrates a case in which all the data signals are applied earlier than the scan signal, it is also possible to set only one address electrode group receive data signals before the scan signal application timing. In other words, the number of the address electrode groups for receiving data signals earlier than the scan signal application timing can vary.

For example, as depicted in FIG. 15*c*, suppose that the scan signal is applied to the scan electrode Y at 'ts'. According to the arrangement sequence of the address electrode groups including the address electrodes $X_1$-$X_n$, respectively, the address electrodes in the electrode group Xa receive data signals Δt earlier than the point when the scan signal is applied to the scan electrode Y, i.e., the data signals are applied to the address electrodes at ts−Δt. Similarly, the address electrodes in the electrode group Xb receive data signals 2Δt earlier than the point when the scan signal is applied to the scan electrode Y, i.e., the data signals are applied to the address electrodes at ts−2Δt. The address electrodes in the electrode group Xc receive data signals at ts−3Δt, and the address electrodes in the electrode group Xd receive data signals at ts−4Δt. All the data signals are applied to each address electrode group including $X_1$-$X_n$ electrodes before the scan signal is applied to the scan electrode Y.

As shown in FIGS. 15*a* to 15*c*, the application timing of the scan signal to the scan electrode Y was set at 'ts', and the application timing difference between the scan signal and its closest data signal was set to Δt. In this way, the application timing difference between the scan signal and its second closest data signal was set to 2Δt. The value of Δt remains constant. In other words, although the data signals are applied to the address electrodes $X_1$-$X_n$ in at least one of the plurality of address electrode groups at different timings from the application timing of the scan signal to the scan electrode Y, the application timing difference between data signals is uniformly set.

It is also possible to differentiate the application timing difference between the scan signal and the data signals to at least one of the address electrode groups, and differentiate the application timing difference between the data signals applied to each of the address electrode groups. For example, if the application timing difference between the scan signal and its closest data signal is set to Δt, it is possible to set the application timing difference between the scan signal and its closest data signal to 3Δt, instead of Δt.

For instance, if ts=0 ns, the address electrodes in the electrode group Xa receive data signals at 10 ns. Therefore, the timing difference between the scan signal applied to the scan electrode Y and the data signals applied to the electrode group Xa is 10 ns. The address electrodes in the address electrode group Xb receive data signals at 20 ns, meaning that the timing difference between the scan signal applied to the scan electrode Y and the data signals applied to the address electrode group Xb is 20 ns. Therefore, the timing difference between the data signal applied to the address electrode group Xa and the data signal applied to the address electrode group Xb equals to 10 ns.

Meanwhile, the address electrodes in the address electrode group Xc receive data signals at 40 ns. Namely, the timing difference between the scan signal applied to the scan electrode Y and the data signals applied to the address electrode group Xc is 40 ns, and the timing difference between the data signal applied to the address electrode group Xb and the data signals applied to the address electrode group Xc is 20 ns. In this way, it is possible to set the application timings of the data signals to the address electrodes $X_1$-$X_n$ to be different from the application timing of the scan signal to the scan electrode Y, and set the data signal application timings to be different from one another at the same time.

Considering the limited amount of time given to the address period, it is preferable to set the timing difference between the data signals applied to the address electrode groups in a range between 10 ns and 1000 ns. In addition, considering a scan signal width according to the operation of the plasma display panel, it is preferable to set Δt in a range from 1/100 to 1 time(s) of a predetermined scan signal width.

Provided that the scan signal is applied to the scan electrode Y at 'ts', the application timing difference between the scan signal and its closest data signal in one subfield can be set uniformly or differently, regardless of the application timing relation among the data signals being applied to the plurality of address electrode groups. As described above, considering the limited amount of time given to the address period, it is preferable to set the timing difference between the scan signal and its closest data signal in a range between 10 ns and 1000 ns. In addition, considering a scan signal width according to the operation of the plasma display panel, it is preferable to set Δt in a range from 1/100 to 1 time(s) of a total address period.

When the scan signal and the data signals are applied to the scan electrode Y and the address electrode groups, respectively, at different timings from one another, it becomes possible to reduce coupling through the capacitance of the panel at each timing for the application of data signals to the address electrodes $X_1$-$X_n$ in each address electrode group as shown in FIGS. 11*a* and 11*b*. Consequently, it becomes possible to reduce noises of waveforms being applied to the scan electrode and the sustain electrode. It becomes also possible to stabilize the address discharge generated in the address period as well as the operation of the plasma display panel.

Further, by maintaining the signal voltages provided to the sustain electrode and the address electrodes during the set-down interval of the reset period at the ground level (GND), the coupling rate between the signal applied to the scan electrode and the signal applied to the sustain electrode can be decreased to thereby prevent changes in a waveform being applied to the scan electrode. In this manner, it becomes possible to secure the operational margin more stably. By stabilizing the address discharge of the plasma display panel, the entire panel can be scanned through one driver (this is called a single scan method).

The application timing difference between the scan signal and the data signals has been explained within one subfield. However, it is also possible to differentiate timings of the data signals being applied to address electrodes by subfields, while keeping the application timing difference between the scan signal for the scan electrode Y and the data signals for the address electrodes $X_1$-$X_n$ or the address electrode groups Xa, Xb, Xc and Xd.

Figure 16:
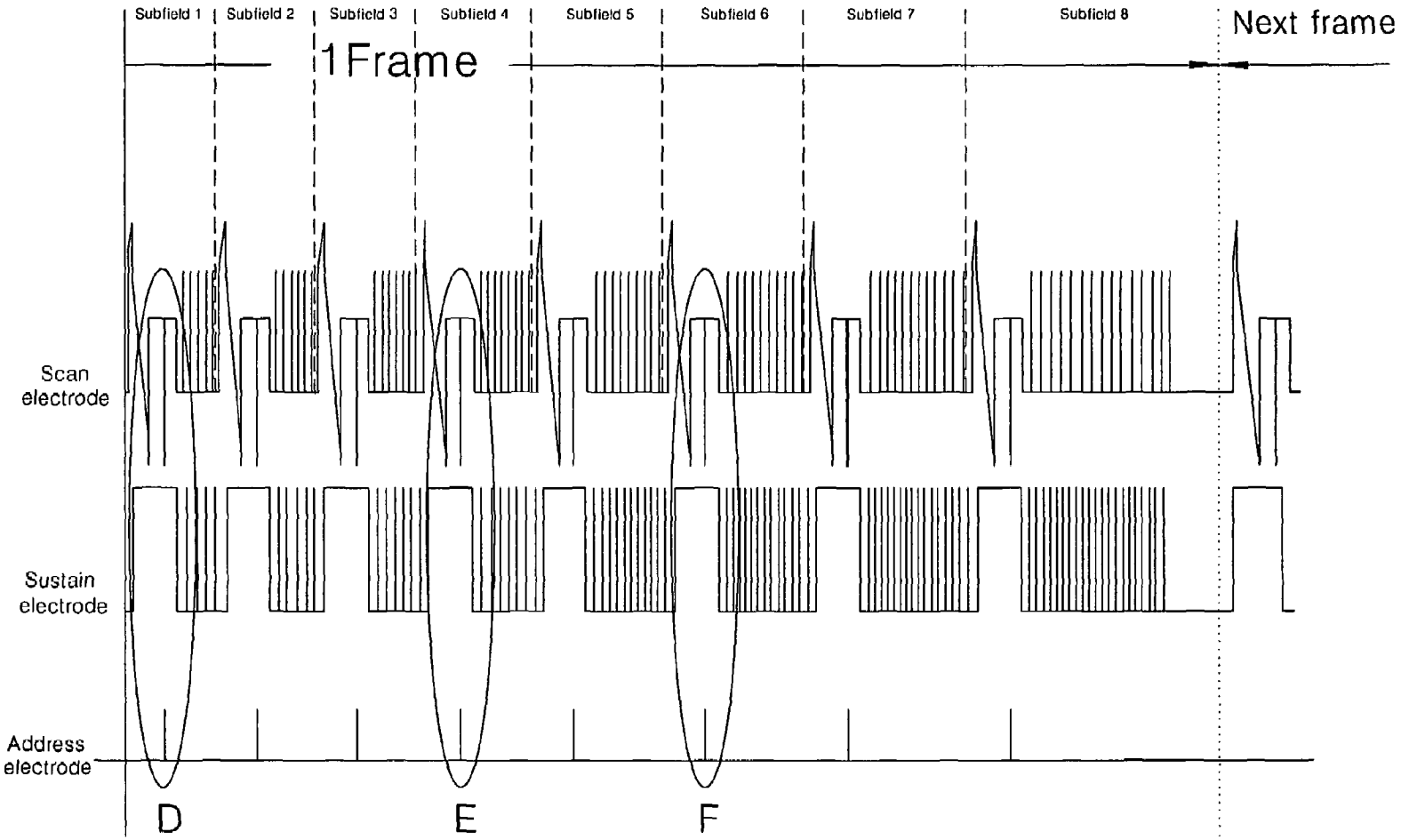
FIG. 16 illustrates still other examples of a driving waveform for explaining a driving method of the plasma display panel according to the embodiment of the present invention.

FIG. 16 illustrates another example of a driving waveform for explaining a driving method of the plasma display panel. Each subfield has a different driving waveform, and the application timings of the scan signal and the data signals are set differently by subfields. In the same subfield, although the application timings of data signals are set differently from that of the scan signal, the application timing difference of data signals being applied to address electrodes is set uniformly. There is also at least one subfield of a frame, in which the timing difference between data signals applied in the address period is different from the timing difference(s) between data signals applied in the address period in other subfield(s) of the frame.

At this time, a signal voltage impressed to the sustain electrode and the address electrodes during the set-down interval of the reset period is maintained at the ground level (GND). The reason for using different timings for the data signals and the scan signal and holding the signal voltage of sustain signal during the set-down interval to the ground level (GND) is to prevent the change of a waveform being applied to the scan electrode caused by the coupling between a signal applied to the scan electrode and a signal applied to the sustain electrode. As such, an operational margin can be secured stably.

One way to illustrate the different application timings between the data signal and the scan signal, in a first subfield of a frame, the data signals are applied to the address electrodes $X_1$ to $X_n$ at different timings from the point when the scan signal is applied to the scan electrode Y, while fixing the timing difference between data signals at Δt, though. Likewise, in a second subfield of a frame, it is possible to set the data signals to be applied to the address electrodes $X_1$ to $X_n$ at different timings from the point when the scan signal is applied to the scan electrode Y, while fixing the timing difference between data signals at 2Δt. Each subfield in a frame can have a different timing difference between data signals, such as 3Δt or 4Δt.

Moreover, it is also possible to use different data signal application timings before and after the scan signal application timing by subfields, while keeping the application timing difference between the scan signal and the data signal within at least one subfield. For instance, if the data signal application timings are set partly before and partly after the scan signal application timing in the first subfield, it is possible to set the application timings for all the data signals before the scan signal application timing in the second subfield, and after the scan signal application timing in the third subfield, respectively.

Figure 17A:
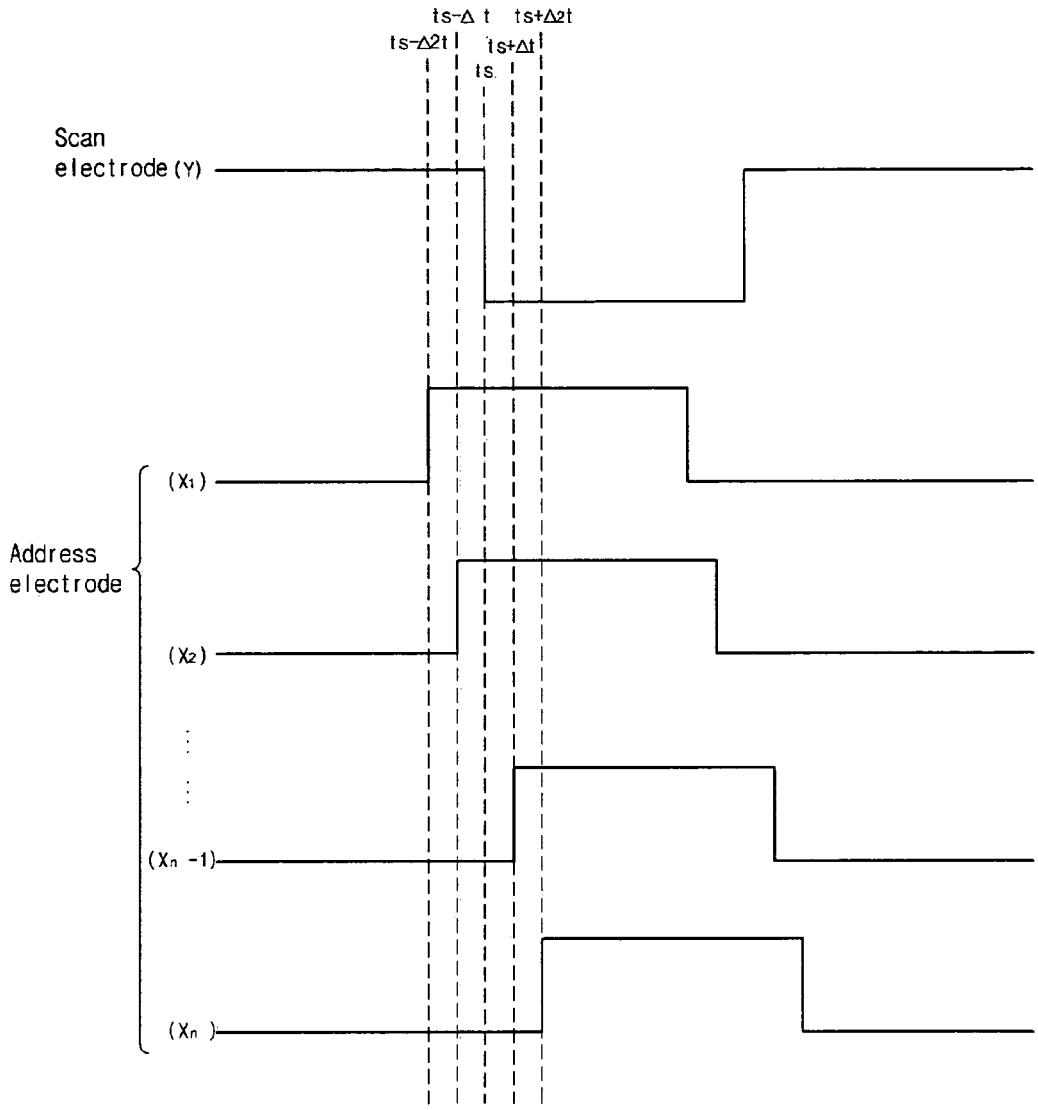
FIG. 17*a* to FIG. 17*c* diagrammatically explain in great detail the driving waveforms of FIG. 16.
Figure 17B:
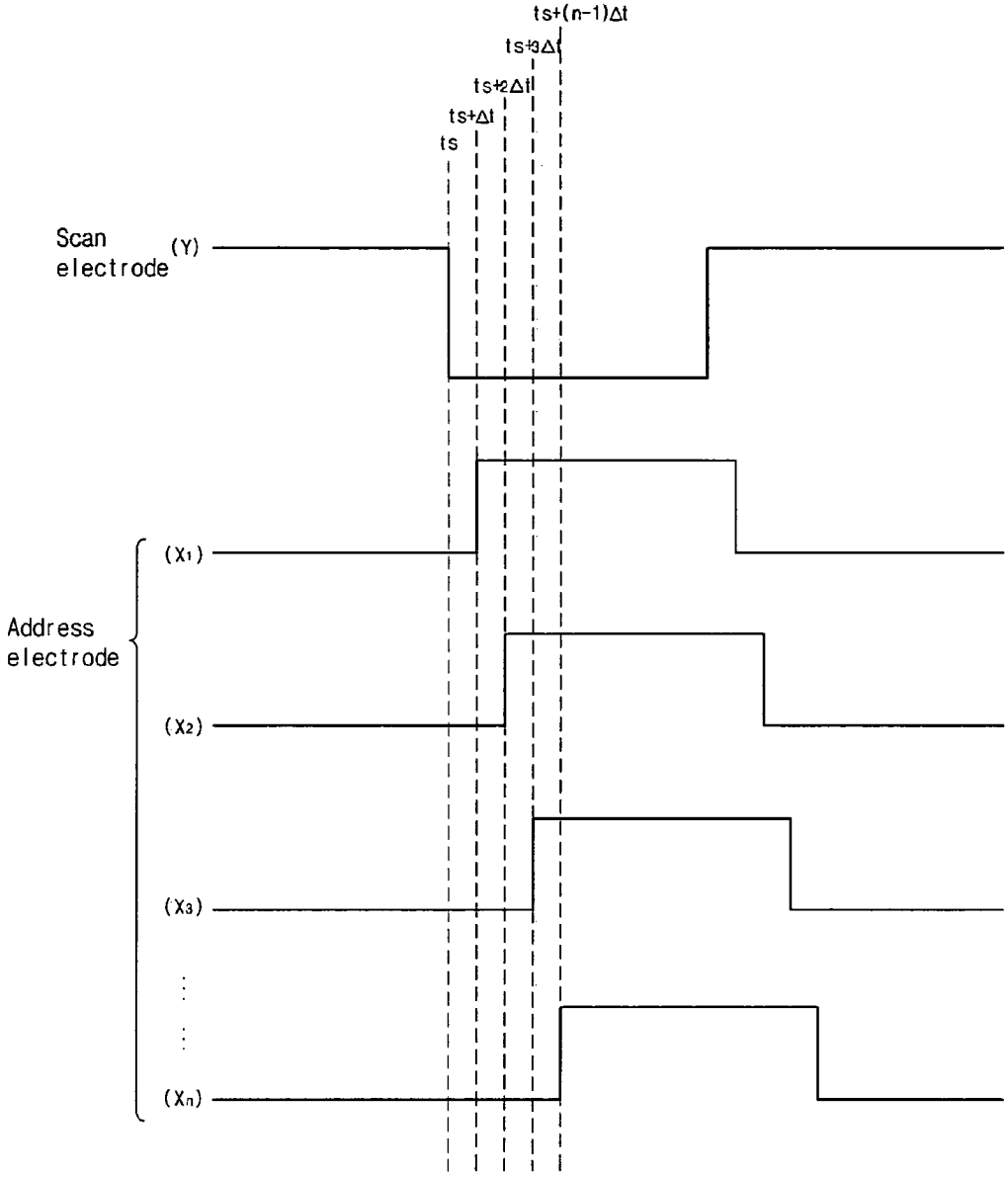
Figure 17C:
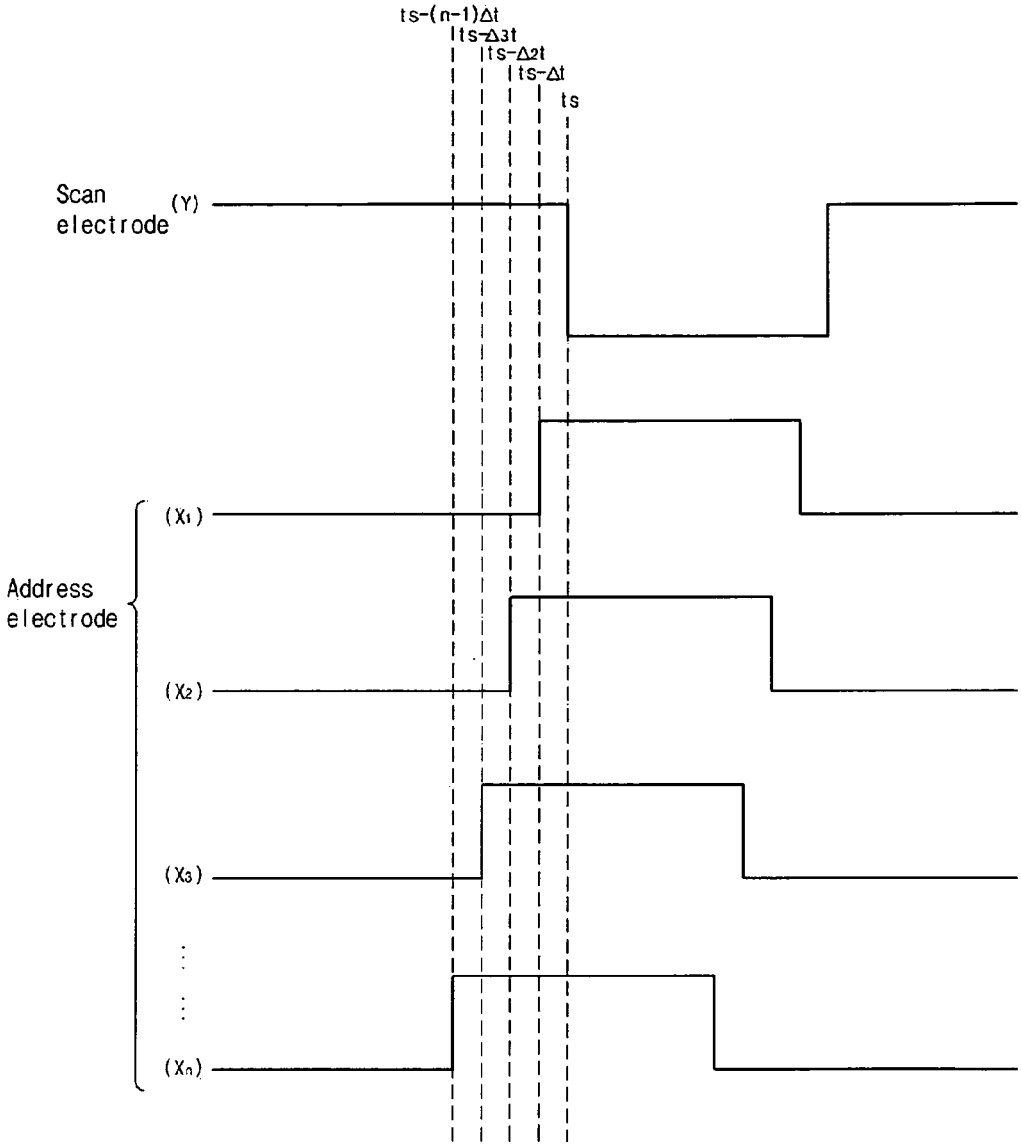

FIG. 17*a* to FIG. 17*c* diagrammatically explain in great detail of areas D, E and F of FIG. 16. In FIG. 17*a*, for instance, suppose that the scan signal is applied to the scan electrode Y at 'ts'. According to the arrangement sequence of the address electrodes $X_1$-$X_n$ in the area D of FIG. 16, the address electrode $X_1$ receives a data signal 2Δt earlier than the point when the scan signal is applied to the scan electrode Y, i.e., the data signal is applied to the address electrode $X_1$ at ts−2Δt. Similarly, the address electrode $X_2$ receives a data signal Δt earlier than the point when the scan signal is applied to the scan electrode Y, i.e., the data signal is applied to the address electrode $X_2$ at ts−Δt. An address electrode $X_{(n-1)}$ receives a data signal at ts+Δt, and an address electrode $X_n$ receives a data signal at ts+2Δt. The data signals are applied to the address electrodes $X_1$-$X_n$ before or after the application timing of the scan signal to the scan electrode Y.

In FIG. 17*b*, the driving waveform of the area E in FIG. 16 is different from the driving waveform of the area D of FIG. 16 although data signals in both driving waveforms are applied at different timings from that of the scan signal. In particular, all the data signals are applied later than the scan signal. However, as shown in FIG. 17*b*, it is also possible to set only one data signal, instead of setting all the data signals, to be applied after the application timing of the scan signal. The number of data signals to be applied later than the application timing of the scan signal can vary.

For instance, as shown in FIG. 17*b*, if the scan signal is applied to the scan electrode Y at 'ts'. According to the arrangement sequence of the address electrodes $X_1$-$X_n$, the address electrode $X_1$, for example, receives a data signal Δt later than the point when the scan signal is applied to the scan electrode Y, i.e., the data signal is applied to the address electrode $X_1$ at ts+Δt. Similarly, the address electrode $X_2$ receives a data signal 2Δt later than the point when the scan signal is applied to the scan electrode Y, i.e., the data signal is applied to the address electrode $X_2$ at ts+2Δt. An address electrode $X_3$ receives a data signal at ts+3Δt, and an address electrode $X_n$ receives a data signal at ts+nΔt.

The driving waveform of FIG. 17*c* illustrates another case in which all the data signals are applied to the address electrodes $X_1$-$X_n$ at different timings, more specifically, earlier than the application timing of the scan signal. Although FIG. 17*c* illustrates a case in which all the data signals are applied earlier than the scan signal, it is also possible to set only one data signal to be applied before the scan signal. In other words, the number of data signals to be applied before the scan signal can vary.

As depicted in FIG. 17*c*, suppose that the scan signal is applied to the scan electrode Y at 'ts'. According to the arrangement sequence of the address electrodes $X_1$-$X_n$, the address electrode $X_1$, for example, receives a data signal Δt earlier than the point when the scan signal is applied to the scan electrode Y, i.e., the data signal is applied to the address electrode $X_1$ at ts−Δt. Similarly, the address electrode $X_2$ receives a data signal 2Δt earlier than the point when the scan signal is applied to the scan electrode Y, i.e., the data signal is applied to the address electrode $X_2$ at ts−2Δt. An address electrode $X_3$ receives a data signal at ts−3Δt, and an address electrode $X_n$ receives a data signal at ts−nΔt. All the data signals are applied to the address electrodes $X_1$-$X_n$ before the scan signal is applied to the scan electrode Y.

By differentiating the application timings between the scan signal and the data signals in the address period by subfields, it becomes possible to reduce coupling through the capacitance of the panel at each timing for the application of data signals to the address electrodes $X_1$-$X_n$. Consequently, it becomes possible to reduce noises of waveforms being applied to the scan electrode and the sustain electrode. This in turn stabilizes the address discharge generated in the address period, and further the operation of the plasma display panel.

Also, by maintaining the signal voltages provided to the sustain electrode and the address electrodes during the set-down interval of the reset period at the ground level (GND), the coupling rate between the signal applied to the scan electrode and the signal applied to the sustain electrode can be decreased to thereby prevent changes in a waveform being applied to the scan electrode. It becomes possible to secure the operational margin more stably. By stabilizing the address discharge of the plasma display panel, the entire panel can be scanned through one driver (this is called a single scan method).

Based on above, it will be appreciated by those skilled in the art that various changes in form and details may be made therein without changing the technical principle and scope of the present invention. For instance, the embodiments described here illustrated two methods, in which different timings were set for the scan signal application and the data signal application, or the address electrodes were divided into four electrode groups, each having the same number of address electrodes, and each electrode group received data signals at different timings from that of the scan signal. Differently from these methods, it is possible to divide the address electrodes $X_1$-$X_n$ into a group of odd-numbered address electrodes and a group of even-numbered electrodes, and set the address electrodes in the same electrode group to receive data signals at the same point, while keeping different application timings between the data signals and the scan signal. Variations are readily apparent based on the description of the present invention.

Still another modification is possible by dividing the address electrodes $X_1$-$X_n$ into a plurality of electrode groups. However, at this time, each of the electrode groups is provided with different numbers of address electrodes. For instance, suppose that the scan signal is applied to the scan electrode Y at 'ts'. The address electrode $X_1$, for example, can receive the data signal at ts+Δt, the address electrodes $X_2$-$X_{10}$ at ts+3Δt, and the address electrodes $X_{11}$-$X_n$ at ts+4Δt.

Figure 18:
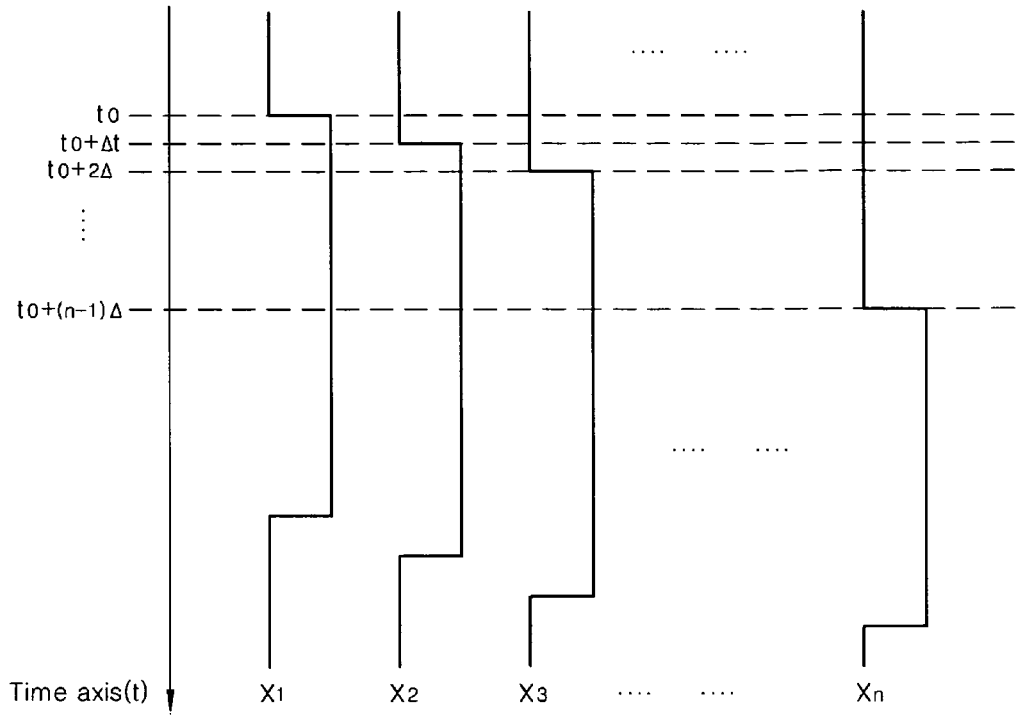
FIG. 18 is a data signal timing chart for explaining a driving method of a plasma display panel according to another embodiment of the present invention.

FIG. 18 is a data signal timing chart for explaining a driving method of a plasma display panel according to another embodiment of the present invention. In an address period, data signals are applied to address electrodes $X_1$-$X_n$ at different timings $t_0$-$t_n$, respectively. According to the arrangement sequence of the electrodes, the electrode $X_1$, for example, receives a data signal at $t_0$, and the electrode $X_2$ receives a data signal at $t_0$+Δt. The electrode $X_n$ receives a data signal at $t_0$+(n−1)Δt. Among the data signal application timings for each X electrode group, suppose that the m-th (here, $1 \leqq m \leqq n-1$) data signal application timing is $t_m$, the (m+1)-th data signal application timing is $t_{(m+1)}$, and the application timing difference is Δt. The application timing difference Δt is fixed at a constant value.

On the other hand, the application timing difference Δt can vary as well. Similar to before, suppose that the m-th (here, $1 \leqq m \leqq n-1$) data signal application timing is $t_m$, the (m+1)-th data signal application timing is $t_{(m+1)}$, and the application timing difference is Δt. However, the application timing difference Δt can have more than two different values. In other words, the electrode $X_1$ receives a data signal at 10 ns, the electrode $X_2$ receives a data signal at 20 ns, and $X_3$ receives a data signal at 40 ns, respectively.

It is preferable to set the application timing difference Δt in a range from 10 ns to 1000 ns. In addition, considering a scan signal width according to the operation of the plasma display panel, it is preferable to set Δt in a range from 1/100 to 1 time(s)

of a predetermined scan signal width. For instance, suppose that the width of a scan signal is 1 μs. Then, the signal application timing difference Δt should be between 1/100 times of 1 μs, i.e., 10 ns, and 1 μs, i.e., 1000 ns (10 ns≦Δt≦1000 ns).

By differentiating the data signal application timings in the address period, it becomes possible to reduce coupling through capacitance of the panel at each application timing of the data signal. Consequently, noises in waveforms being applied to the scan electrode Y and the sustain electrode Z can be greatly reduced.

Figure 19:
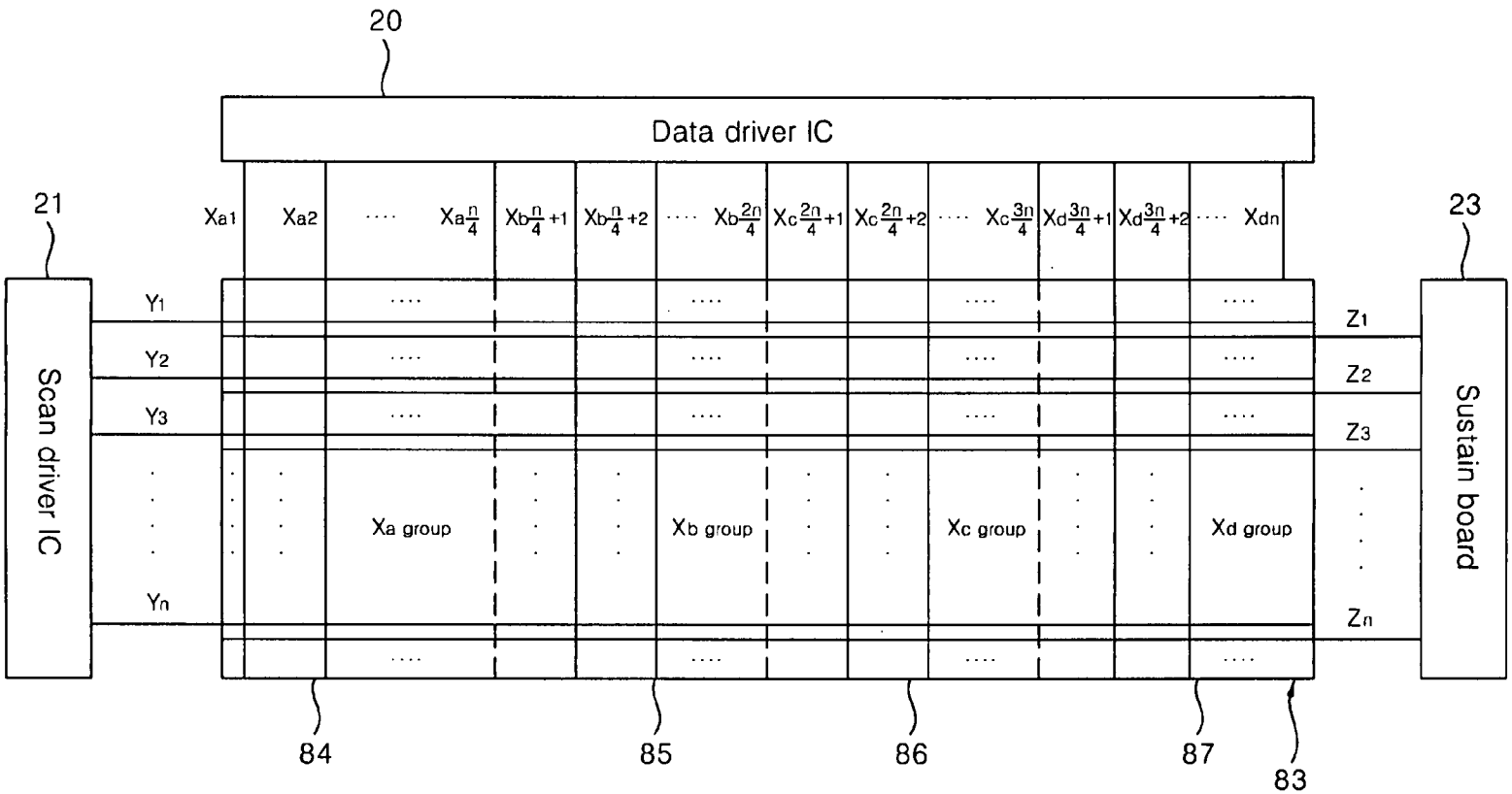
FIG. 19 is an explanatory diagram for a driving method based on electrode group division for use in the plasma display panel according to another embodiment of the present invention.

Although the embodiment shown in FIG. 18 suggested to apply data signals to all of the electrodes $X_1$-$X_n$ at different timings $t_0$-$t_n$, respectively, it is also possible to set at least one of the data signals to be applied concurrently to at least two electrodes or less than (n−1) electrodes, which is illustrated in FIG. 19.

As depicted in FIG. 19, address electrodes $X_1$-$X_n$ of a plasma display panel 83 are divided into Xa electrode group ($Xa_1$-$Xa_{(n)/4}$) 84, Xb electrode group ($Xb_{(n/4+1)}$-$Xb_{(2n)/4}$) 85, Xc electrode group ($Xc_{(2n/4+1)}$-$XC_{(3n)/4}$)86, and Xd electrode group ($Xd_{(3n/4+1)}$-$Xd_{(n)}$)87. At least one these address electrode groups receive data signals at a different timing from the others. For example, all of the electrodes ($Xa_1$-$Xa_{(n)/4}$) in the Xa electrode group 84 can receive data signals at the same point, whereas the electrodes in the other electrode groups 85, 86, and 87 receive data signals at different timings from that of the Xa electrode group.

Similar to FIG. 14, each address electrode group X has the same number of address electrodes. However, both the number of address electrodes and the number of address electrode groups can be adjusted. In effect, the number of address electrode groups, N, is preferably in a range of 2≦N≦(n−1), wherein n is a total number of address electrodes.

Preferably, the number of address electrode groups is in a range of 3≦N≦5. This range is defined in consideration of the circuit implementation for data signal application during the operation of a plasma display panel, the operation control, the operational speed etc. In order to obtain an excellent picture quality following the standards of VGA (Video Graphics Array), XGA (Extended Video Graphics Array) and HDTV (High Definition Television), the number of data electrodes included in one electrode group is preferably in a range between 100 and 1000 (100≦N≦1000), more preferably, between 200 and 500 (200≦N≦500).

FIG. 19 illustrates the structure of the panel 83, in which a data driver IC, a scan driver IC, and a sustain board are spaced apart from the panel by a predetermined distance, respectively, and the data driver IC, the scan driver IC and the sustain board are connected to the address electrodes X, Y and Z. However, this structure was introduced for convenience, and in effect the data driver IC, the scan driver IC and the sustain board may be connected with the panel 83.

Figure 20:
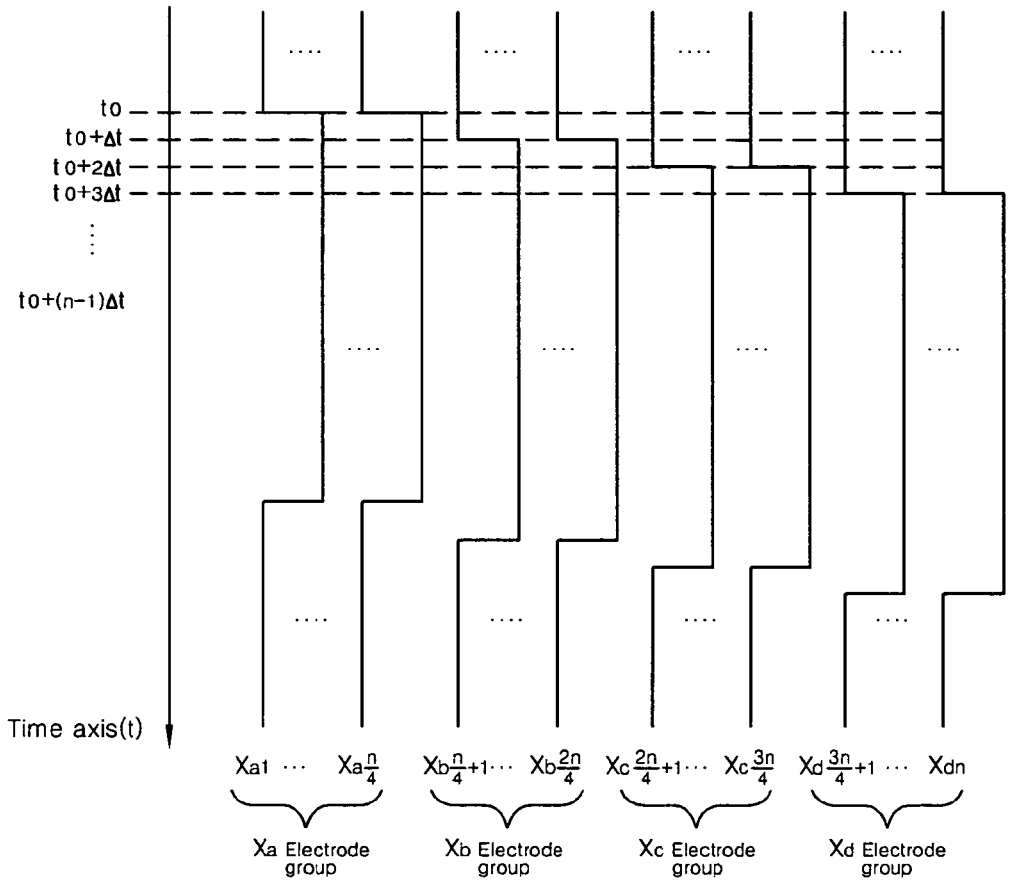
FIG. 20 is a data signal timing chart based on electrode group division for the plasma display panel according to another embodiment of the present invention.

FIG. 20 is a data signal timing chart based on electrode group division for the plasma display panel. Although electrodes in the same electrode group (one of Xa electrode group, Xb electrode group, Xc electrode group and Xd electrode group) receive data signals at the same point, electrodes in different electrode groups may receive data signals at different timings from one another.

For example, according to the arrangement sequence of the address electrode groups, the address electrodes ($Xa_1$-$Xa_{(n)/4}$) in the Xa electrode group, for example, concurrently receive data signals at $t_0$. The address electrodes ($Xb_{(n/4+1)}$-$Xb_{(2n)/4}$) in the Xb electrode group concurrently receive data signals at $t_0$+Δt, and the address electrodes ($Xc_{(2n/4+1)}$-$XC_{(3n)/4}$) in the Xc electrode group receive data signals at $t_0$+2Δt. The address electrodes ($Xd_{(3n/4+1)}$-$Xd_{(n)}$) in the Xd electrode group receive data signals at $t_0$+3Δt.

Among the data signal application timings for each X electrode group, suppose that the m-th (here, 1≦m≦n−1) data signal application timing is $t_m$, the (m+1)-th data signal application timing is $t_{(m+1)}$, and the application timing difference is Δt. The application timing difference Δt is fixed at a constant value. That is, the difference between two (temporarily) subsequent timings, $t_m$ and $t_{(m+1)}$ for example, is a constant value, i.e., $t_m$−$t_{(m+1)}$=Δt=constant value.

On the other hand, the application timing difference Δt can vary as well. Similar to before, suppose that the m-th (here, 1≦m≦n−1) data signal application timing is $t_m$, the (m+1)-th data signal application timing is $t_{(m+1)}$, and the application timing difference is Δt. In this case, however, the application timing difference Δt can have more than two different values. That is to say, the Xa electrode group receives data signals at 10 ns, the Xb electrode group receives data signals at 20 ns, and the Xd electrode group receives data signals at 40 ns, respectively. It is preferable to set the application timing difference Δt in a range from 10 ns to 100 ns. In addition, considering a scan signal width according to the operation of the plasma display panel, it is preferable to set Δt in a range from 1/100 to 1 time(s) of a predetermined scan signal width.

Figure 21:
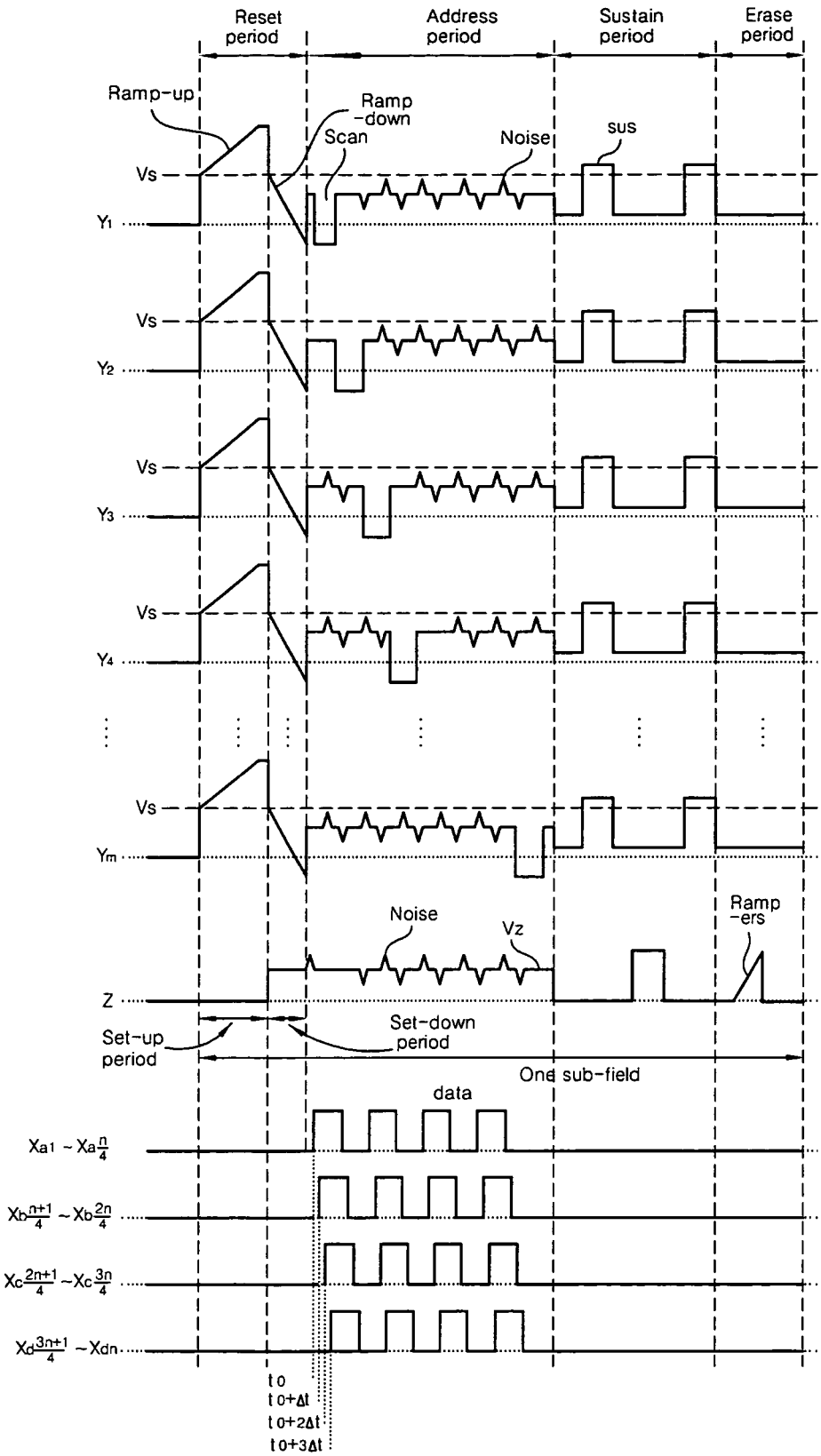
FIG. 21 diagrammatically explains how noises are reduced by a driving waveform of the plasma display panel according to another embodiment of the present invention.

FIG. 21 diagrammatically explains how noises are reduced by the driving waveform of the plasma display panel according to the second embodiment of the present invention. A considerable amount of noises is reduced from the waveforms being applied to the Y and Z electrodes. The noises were reduced because the data signals were not applied to the address electrodes $X_1$-$X_n$ at the same point. In other words, by applying the data signals to the four electrode groups at different timings from one another, coupling through capacitance of the panel at each timing was reduced.

At a point when a data signal rapidly rises (i.e., at a rising edge), rising noises in the waveforms applied to the Y and Z electrodes were reduced. Likewise, at a point when a data signal rapidly falls (i.e., at a falling edge), falling noises in the waveforms applied to the Y and Z electrodes were also reduced. Therefore, the address discharge generated in the address period was stabilized, and further the operation efficiency of the plasma display panel was improved.

As aforementioned, it should be understood by those skilled in the art that various changes in form and details may be made therein without departing from the spirit and scope of the invention. For instance, the embodiments described so far illustrated two methods, in which different timings were set for the data signal application to every electrode $X_1$-$X_n$, or the address electrodes were divided into four electrode groups, each having the same number of address electrodes, and each electrode group received data signals at different timings from one another. Differently from these methods, it is possible to divide the address electrodes $X_1$-$X_n$ into a group of odd-numbered address electrodes and a group of even-numbered electrodes, and set the address electrodes in the same electrode group to receive data signals at the same point, while keeping different application timings for data signals by electrode groups.

Still another modification is possible by dividing the address electrodes $X_1$-$X_n$ into a plurality of electrode groups. However, in this case, each of the electrode groups is provided with different numbers of address electrodes. Then, the address electrode $X_1$, for example, can receive the data signal at $t_0$, the address electrodes $X_2$-$X_{10}$ at $t_0$+Δt, and the address electrodes $X_{11}$-$X_n$ at $t_0$+2Δt.

Moreover, even though it is not shown in the driving method for the plasma display panel according to the second embodiment of the present invention, the pre-reset period can be included before the reset period. Since the driving waveform being applied in the pre-reset period is same as that of the first embodiment of the present invention, unnecessary description on the driving waveform will not be provided here.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A plasma display device comprising:

a plurality of scan electrodes in a first direction;

a plurality of sustain electrodes the first direction;

a plurality of address electrodes in a second direction that is substantially perpendicular to the first direction;

a plurality of cells, each cell having corresponding scan, sustain and address electrodes, a first driving circuit configured to drive the plurality of scan electrodes;

a second driving circuit configured to drive the plurality of sustain electrodes; and a third driving circuit configured to drive the plurality of address electrodes, wherein a plurality of sub-fields are used for providing gray scale, and during an address period of at least one sub-field, a scan waveform is provided to at least one scan electrode by the first driving circuit, and during the address period, address waveforms to select at least one cell receiving the scan waveform are provided to the plurality of address electrodes by the third driving circuit, wherein all start timings of the address waveforms during the address period are offset from a start timing, during the address period, of the scan waveform corresponding to the address waveforms and the at least one sub-field includes a pre-reset period prior to a reset period, and wherein a negative voltage is provided to the scan electrode in the pre-reset period and a positive voltage is provided to the sustain electrode in the pre-reset period.

2. The plasma display device of claim 1, wherein the pre-reset period is provided only in a first sub-field of the plurality of sub-fields.

3. The plasma display device of claim 1, wherein the start timings of the address waveforms are provided in the address period prior to the start timing of the scan waveform in the address period.

4. The plasma display device of claim 1, wherein the start timings of the address waveforms are provided after the start timing of the scan waveform in the address period.

5. The plasma display device of claim 1, wherein the start timings of the plurality of address waveforms for selecting corresponding cells in a row corresponding to the at least one scan electrode are offset from the start timing of the scan waveform.

6. The plasma display device of claim 5, wherein the offset is based on a prescribed time period Δt.

7. The plasma display device of claim 6, wherein the start timing of each of the plurality of address waveforms is offset by Δt from one another.

8. The plasma display device of claim 7, wherein a first group of the plurality of address waveforms is provided in the address period prior to the start timing of the scan waveform in the address period.

9. The plasma display device of claim 7, wherein a second group of the plurality of address waveforms is provided in the address period after the start timing of the scan waveform in the address period.

10. The plasma display device of claim 7, wherein a first group of the plurality of address waveforms is provided in the address period prior to the start timing of the scan waveform in the address period, and a second group of the plurality of address waveforms is provided in the address period after the start timing of the scan waveform in the address period.

11. The plasma display device of claim 10, wherein the first and second groups have a same number of address electrodes.

12. The plasma display device of claim 6, wherein the prescribed time period Δt is 10ns to 1000ns.

13. The plasma display device of claim 6, wherein the prescribed time period Δt is in a range from 1/100 of a scan waveform width to the scan waveform width.

14. The plasma display device of claim 1, wherein the plurality of address electrodes are distributed between a plurality of groups, and the start timings of the address waveforms in the address period for at least one group is offset from the start timing of the scan waveform in the address period.

15. The plasma display device of claim 14, wherein a same number of address electrodes are provided in each of the plurality of groups.

16. The plasma display device of claim 14, wherein the start timings of the address waveforms of the at least one group is provided in the address period prior to the start timing of the scan waveform in the address period.

17. The plasma display device of claim 16, wherein the start timings of the address waveforms of at least one another group is provided in the address period after the start timing of the scan waveform in the address period.

18. The plasma display device of claim 14, wherein the start timings of the address waveforms of the at least one group is provided in the address period after the start timing of the scan waveform in the address period.

19. The plasma display device of claim 14, wherein the start timings of address waveforms of each group is offset from one another by a prescribed time period Δt.

20. The plasma display device of claim 19, wherein the prescribed time period Δt is 10ns to 1000ns.

21. The plasma display device of claim 19, wherein the prescribed time period Δt is in a range of 1/100 of a scan waveform width to the scan waveform width.

22. The plasma display device of claim 1, wherein during a set-down period of the reset period in the at least one sub-field, the sustain electrodes are maintained at a ground potential or 0 voltage.

23. The plasma display device of claim 1, wherein the address period to select a cell to be discharged.

24. The plasma display device of claim 1, wherein the address period is provided after the reset period of the at least one sub-field and prior to a sustain period of the at least one sub-field.

25. A method of driving a plasma display device having a plurality of scan and sustain electrodes in a row direction, and a plurality of address electrodes in a column direction such that a plurality of cells are formed in a matrix arrangement, the method comprising:

providing a scan signal to a corresponding scan electrode during an address period of at least one sub-field; and providing address signals to select a cell receiving the scan signal during the address period, wherein all start timings of the address signals during the address period are offset from a start of the scan signal corresponding to the address signals during the address period and the at least one sub-field includes a pre-reset period prior to a reset period, and wherein a negative voltage is provided to the scan electrode in the pre-reset period and a positive voltage is provided to the sustain electrode in the pre-reset period.

26. The method of claim 25, wherein the address period to select a cell to be discharged.

* * * * *